US006437503B1

(12) United States Patent
Konuma

(10) Patent No.: US 6,437,503 B1
(45) Date of Patent: Aug. 20, 2002

(54) ELECTRON EMISSION DEVICE WITH PICTURE ELEMENT ARRAY

(75) Inventor: Kazuo Konuma, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/506,003

(22) Filed: Feb. 17, 2000

(30) Foreign Application Priority Data

Feb. 17, 1999 (JP) ..... 11-038210

(51) Int. Cl.[7] ..... H01J 31/12
(52) U.S. Cl. ..... 313/495; 313/496; 313/497
(58) Field of Search ..... 313/495, 309, 313/310, 336, 351

(56) References Cited

U.S. PATENT DOCUMENTS 3,783,325 A * 1/1974 Shelton ..... 313/336
4,008,412 A * 2/1977 Yuito et al. ..... 313/309
4,345,181 A * 8/1982 Shelton ..... 313/309
4,874,981 A * 10/1989 Spindt ..... 313/309
5,252,833 A * 10/1993 Kane et al. ..... 250/423
5,489,933 A * 2/1996 Betsui et al. ..... 347/120
5,506,482 A * 4/1996 Teramatsu et al. ..... 315/382
5,528,103 A * 6/1996 Spindt et al. ..... 313/497
5,552,659 A * 9/1996 Macaulay et al. ..... 313/310
5,864,201 A * 1/1999 Gehring et al. ..... 313/412
6,084,245 A * 7/2000 Hsu et al. ..... 257/10

FOREIGN PATENT DOCUMENTS

JP 54145472 11/1979
JP 9306396 11/1997

* cited by examiner

*Primary Examiner*—Sandra O'Shea
*Assistant Examiner*—Bao Q. Truong
(74) *Attorney, Agent, or Firm*—Young & Thompson

(57) ABSTRACT

An electron emission device includes: a substrate; a gate electrode that has an opening and is disposed on the substrate; an emitter that is formed in the opening; and an anode electrode that is disposed at a predetermined interval from the emitter. In this device, a convergence electric field by which electrons to be emitted from the emitter is converged toward the anode electrode side is formed, the convergence electric field has equipotential surface whose inclination increases according as it approaches the emitter, and a relationship represented by expression below is satisfied:

$$\{t(gk)/t(ak)\}\cdot Va<Vg<[\{(t(g)+t(gk)\}/t(ak)]\cdot Va.$$

23 Claims, 21 Drawing Sheets

ELECTRON EMISSION DEVICE WITH PICTURE ELEMENT ARRAY

FIELD OF THE INVENTION

This invention relates to an electron emission device with an improved emission-widening characteristic, and relates to a method of driving the electron emission device.

BACKGROUND OF THE INVENTION

Electron emission devices have functions of capturing electrons emitted from emitter by anode electrode and recognizing it as electrical signal, or enabling fluorescent part on anode electrode to emit light by electronic excitation in capturing electrons and recognizing it as optical signal. Application examples to recognize the electrical signal are amplifiers generally called vacuum tube, oscillators etc. On the other hand, application examples to recognize the optical signal are cathode-ray tubes, fluorescent display tubes, a flat-type display called FED (field emission display) etc.

As an example of the conventional electron emission devices, FED is explained below.

FIG. 1 is a cross sectional view illustrating one picture element in a conventional FED. Shown is a structure that electrons are emitted to excite red fluorescent part to emit light. Here, a picture element means a minimum unit when an image displayed by the FED is space-divided. In FED that a color picture is displayed by a display system of optical three primary colors, i.e. R(red), G(green) and B(blue), one of the colors, e.g. R(red), is called a picture element.

As shown in FIG. 1, $SiO_2$ film of about 1 $\mu$m thick, as insulation, film 2, is deposited on substrate 1 by sputtering, aluminum film of about 200 nm thick, as gate electrode 3, is deposited on the insulation film 2, a tubular gate hole 4 is formed penetrating the gate electrode 3 and insulation film 2. Emitter 5 is formed with cathode material deposited on the substrate 1 at the bottom of the gate hole 4. Also, anode electrode 6 is disposed around 5 mm above the substrate 1. Fluorescent material 7 with red fluorescent property is coated on part of the anode electrode 6 located just over the gate hole 4.

A voltage of about 5.1 kV is applied to the anode electrode 6 and the fluorescent part 7.0 V is applied to the emitter 5 of cathode material, and about 100 V is applied to the gate electrode 3. By thus applying the voltages, equipotential surface 8 is formed. Here, the distance, between the anode electrode 6 and the gate electrode 3 is 5 mm, and the voltage is 5000 V. So, electric field between the both electrodes 6 and 3 is given by:

$$5000/5\ [\mathrm{V/mm}]=1\ [\mathrm{kV/mm}].$$

On the other hand, the distance between the gate electrode 3 and the emitter 5 is 1 $\mu$m ($10^{-3}$ [mm]), and the voltage is 100 V. So, the electric field between the both electrodes 3 and 5, gate and emitter is given by:

$$100/10^{-3}\ [\mathrm{V/mm}]=100\ [\mathrm{kV/mm}].$$

Thus, the value of electric field between gate and emitter is 100 timer, the value of electric field between the anode electrode 6 and the gate electrode 3. Therefore, at the inside of the gate hole 4 and its vicinity, the center of the gate hole 4 floats on the equipotential surface 8 to function as a circular hole lens. In this circular hole lens, in the vicinity of the center axis of the gate hole 4, electric field applied to the emitter 5 is weakened. In other words, the circular halt lens has power to diverge electrons, and electrons being emitted from positions off the center axis (convergence axis) are thus provided with electron tracks being curved in the direction of getting away from the axis (in the widening direction) Here, "power" of the circular hole lens means energy, which is owned by the equipotential surface 8 composing the circular hole lens, to diverge or converge electrons.

The phenomenon that the electron emission tracks are curved by the circular hole lens effect is detailed below. In FIG. 1 the emitter 5 is divided into small regions, and electron tracks emitted from the respective regions are shown. Since the gate hole 4 has an axially symmetrical shape, the emitter 5 deposited at the bottom of the gate hole 4 is divided into three regions from the near side of axis to the far side of axis. The regions sectioned by concentric circles like an archery target are called a, b and c from the center. Region a is a region that includes the axis. 9 is electron emitted from region a, 10 is electron emitted from region b, and 11 is electron emitted from region c. The respective electrons 9, 10 and 11 are widened outside in the order of regions a, b and c.

However, in the above electron emission device, there is a problem that electrons 9, 10 an 11 omitted are diverged in the direction of getting away from the axis while they travel to the anode electrode 6. Since in FED the picture elements are arrayed being divided finely, when elections are diverged, there occurs a problem that electron arrives at fluorescent part 7 of the neighboring picture element, not fluorescent part 7 of its own picture element. If electron arrives at fluorescent part 7 of a different color's picture element, then a different color is created. Also, if electron arrives at fluorescent part 7 of a neighboring same-color's picture element, then a failure in space revolution occurs.

FIG. 2 is a graph shaving an operation characteristic of the conventional electron emission device in FIG. 1. Shown in FIG. 2 is the relationship between cathode applied electric field and amount of emission current. The cathode applied electric field shown in the graph is applied to the emitter 5 deposited at the bottom of the gate hole 4. Herein, the value of electric field at the mean height (in 1 $\mu$m insulation film structure, a height of 0.5 $\mu$m) of gate hole is used as a value of cathode applied electric field.

When the cathode applied electric field increases gradually, electric field (threshold electric field) where emission current starts flowing appears. A maximum value in a necessary amount of emission current is called a maximum amount of current, and cathode applied electric field required to get that amount of current is called maximum electric field. To display an image in analogue system by FED, according to input signal, it is necessary to apply arbitrary electric field between the threshold electric field and the maximum electric field to get a desired brightness of fluorescent light. In pulse width drive system, a desired brightness of fluorescent light can be obtained by controlling the time of applying a certain electric field e.g., maximum electric field.

If there is a limit to the emission(or emission electron)-widening characteristic, the electron emission device only has to be driven according to the emission characteristic in FIG. 2. However, in fact, the emission may be, widened greater than the limit due to the circular hole lens effect. The bigger the difference of electric field at the opening of gate hole (phenomenon (1)) or the farther, the emission position of electron deviated from the axis (phenomenon (2)), the more significantly the widening phenomenon of electron due to the circular hole lens effect occurs.

FIG. 3 is a graph showing the phenomenon (1) when the difference of electric field at the opening of gate hole is big when the cathode applied electric field is increased while keeping the voltage of the anode electrode 6 constant, there occur phenomena such as (1') the distortion of equipotential surface increases and (2') the velocity at the opening of gate hole increases. By the phenomena (1') and (2')) the range of emission widening when arriving at the anode electrode 6 is further extended.

As "length D" to represent the widening range above-mentioned in FIG. 3, the, range indicated by arrow D in FIG. 1 is used. In order to increase the cathode applied electric field, the potential of gate electrode is increased. That there occurs the problem that electron plunges into the neighboring fluorescent part means the widening range "D" is already exceeding the limit. Strictly thinking, since electron plunging into an invalid region such as a black matrix does not excite the fluorescent part, that there is electron not plunging into predetermined fluorescent part means the limit of widening is exceeded already. Although the critical widening varies as the case may be, it is definite that there is a certain limit. The widening range "D" is called critical widening length, and the cathode applied electric field to yield the characteristic is called critical electric field.

In electron emission devices used as FED or another application, to use cathode applied electric field greater than the critical electric field is allowed. So, the maximum electric field needed to get the maximum amount of current must be less than the critical electric field. The conventional electron emission devices using the gate hole structure are always subject to the influence of the circular hole lens effect since they are operated so that the inside electric field of the gate hole is more intensive than the outside one. Especially, the tendency that the degree of widening increases as it approaches the maximum amount of current is not desirable. In this tendency, even when a small ratio of emission electrons are plunging into a substandard region, due to the big total number of electrons, the influence is sufficiently remarkable. Alternatively, unnegligible number of electrons, as a noise, plunges into the substandard region.

SUMMARY OF THE INVENTION

Accordingly, it is an object of the invention to provide an electron emission device with emission-widening characteristics.

It is a further object of the invention to provide a method for driving such an electron emission device.

According to the invention, an electron emission device, comprises:

a substrate;

a gate electrode that has an opening and is disposed on the substrate;

an emitter that is formed in the opening; and an anode electrode that is disposed at a predetermined interval from the emitter;

wherein a convergence electric field by which electrons to be emitted from the emitter is converged toward the anode electrode side is formed, the convergence electric field has equipotential surface whose inclination increases according as it approaches the emitter, and a relationship represented by expression below is satisfied:

$$\{t(gk)/t(ak)\}\cdot Va<Vg<[\{(t(g)+t(gk)\}/t(ak)]\cdot Va.$$

where distance between the surface of the emitter and the back surface of the gate electrode is t(gk), distance between the back surface of the anode electrode and the surface of the emitter in t(ak), potential of the anode electrode is Va, potential of the gate electrode is Vg, and thickness of the gate electrode is t(g).

In the electron emission device of this invention, the convergence electric field can function as a lens (circular hole lens) to converge electrons emitted from the cathode electrode (emitter), therefore, suppressing the emission widening not to widen the emission track of electron, keeping the arrival state of electron at the anode electrode properly. When electrons curved by the convergence of lens come to the over-focused state to cross electrons before the anode electrode, electrons arrive at the anode electrode in a widened distribution. However, the widening characteristic by the over-focused state is remarkably narrower than the case of the conventional electron emission devices which incur the effect of a divergence system lens by distortion of equipotential surface. The reason is as follows. Namely, when electric field given between gate electrode and emitter is smaller than electric field given between anode electrode and gate electrode, the electric field and the amount of electron emission are most around the center axis of the lens and the amount of electron emission reduces as it departs from the axis. By the influence of spherical aberration of lens, there occurs an electron emission distribution that at the further end of lens (position deviated from the axis) the bigger the divergence power is, and the amount of electron emission in most at the center of the axis and reduces as it departs from the center of the axis. Therefore, the electron-widening phenomenon can be prevented. On the other hand, in the divergence system lens of the conventional electron emission devices, electric field to effect the emitter around the center axis of the lens is weakest, the number of electrons traveling at the circumference are most, therefore accelerating the widening of electron. Comparing the widening phenomenon by over-focusing in this invention with the widening phenomenon by divergence system lens in the conventional electron emission devices, it is obvious that the widening of the over-focused system is smaller, when using the lens with similar power.

Here, it is preferable that the convergence electric field is formed by setting so that gate/emitter electric field given between the gate electrode and the emitter is smaller than gate/anode electric field given between the gate electrode and the anode electrode. In this case, electric field with the convergence effect of electron can be obtained easily.

Also, it is preferable that adding to the relationship between the gate/emitter electric field and the gate/anode electric field, even when the gate/emitter electric field is greater than the gate/anode electric field, the convergence electric field has equipotential surface whose. Inclination increases according as it approaches the emitter.

In this case, desired widening characteristic conditions can be used to the fullest. Provided that electrons emitted from the emitter have no lateral velocity or negligibly small originally, when there exists no lens effect by the distortion of equipotential surface, the linearity in movement of emission electron is best and the widening of electron arriving at the anode electrode is least. The state that no lens affect exists means that there is no change in electric field around the gate electrode. This state can be created by equalizing the gate/emitter electric field to the gate/anode electric field. When setting gate/emitter electric field greater than this state, the divergence system lens occurs slightly, the amount of electron emission also increases with an increase in electric field applied to the emitter. Even in this state with the slightly-occurring divergence effect, the widening characteristic may fall within the acceptable range, so, by operating the electron emission device including this range, the more amount of electron emission from the emitter can be captured.

Also, it is preferable that the emitter is formed as such a structure with a cone-shaped hollow that it protrudes at the sidewall of the opening toward the gate electrode. In this case, the convergence electric field can be suitably by the structure with a cone-shaped hollow.

Also, it is preferable that the emitter is formed narrower than the diameter of the opening. Alternatively, the emitter may be formed like a ring. Limited by that electrons emitted from the cathode electrode in the opening deviate from a desired range of tracks to the anode electrode, electric field more than that value may not be applied. However, in this composition, the emitter at the sidewall or center of the opening is removed. So, the limitation above can be eliminated and the higher electric field can be applied to the bottom of the opening.

Further, it is preferable that the emitter is of cathode materials that have emission characteristics different from each other. In this case, for example, by mixing cathode material of normal emission characteristics with cathode material of emission characteristics that, owing to high threshold electric field in electron emission, have a low degree of electron emission even when electric field more than the threshold electric field is applied, the range of selection for a desired emission and widening characteristic can be widened, as compared with using one kind of cathode material.

Also, it is preferable that a plurality of the openings are arrayed in the gate electrode, and the emitters formed in the openings are aligned each other. Thereby, the phenomenon that emission is widened uselessly in the lateral direction can be prevented.

Also, it is preferable that the opening is formed as a nearly rectangle, and the emitter is formed like a strip along the longitudinal direction of the opening. In this case, the corresponding openings to respective picture elements can be adjacent to each other, and the corresponding fluorescent parts to respective picture elements can be separated from each other in the direction orthogonal to the longitudinal direction of the opening.

Also, it is preferable that three picture elements, each of which is composed of the emitter and the gate electrode, are arrayed adjacent to each other, the emitter of the first picture element located at the center of the three picture elements extends longitudinally at the center of the nearly rectangular opening, the emitter of the second picture element located at one end of the three picture elements extends longitudinally on the first picture element side of the nearly rectangular opening, and the emitter of the third picture element located at another end of the three picture elements-extends longitudinally on the first picture element side of the nearly rectangular opening.

In this case, for the composition that the corresponding fluorescent parts to respective picture elements are separated from each other, for example, the emission widening characteristic toward directly above is assigned to electrons emitted from the emitter of green picture element, the emission widening characteristic toward above left is assigned to electrons emitted from the emitter of red picture element, and the emission widening g characteristic toward above right is assigned to electrons emitted from the emitter of blue picture element.

Also, it is preferable that the gate electrode is formed as a nearly rectangle and a plurality of the openings are formed at the center and corners of the gate electrode, in the opening located at the center, the emitter extending longitudinal along the gate electrode at the center of the opening, in the openings located at the corners, the emitters extending shifted outside from the center of the openings. In this ease, the emission widening characteristics can be set suitably.

According to another aspect of the invention, an electron emission device, comprises:

a substrate;

a gate electrode that has an opening and is disposed on the substrate;

an emitter that is formed in the opening; and an anode electrode that is disposed at a predetermined interval from the emitter;

wherein a convergence electric field by which electrons to be emitted from the emitter is converged toward the anode electrode side is formed, the convergence electric field has equipotential surface formed like a leas with a convergence axis, and the lens-like equipotential surface enables electrons to be emitted from the emitter to travel up to the anode electrode while being controlled from the just-focused state lying on the convergence axis to the over-focused state crossing the convergence axis.

Here, it is preferable that the electrons in the over-focused state shoot the anode electrode in a range narrower than the opening. In this case, emission electrons can be shot to the anode electrode focusing in a narrower range than the area of gate opening. When fluorescent material is coated on the anode electrode so that it has the same or larger size than the area of gate opening, all electrons emitted toward the anode electrode con be supplied to the fluorescent part.

According to another aspect of the invention, a method for driving the electron emission device composed as described above, wherein:

electric field between the anode electrode and the emitter is set as a threshold value.

In this driving method, it can be operated using a positive voltage by which the gate modulation potential is not biased. In using a display composed of multiple pixels, when the threshold electric fields of pixel are different each other, it is set to be a threshold value at the minimum potential. Some dispersion can be stored into external semiconductor storage and then used for the gate modulation.

According to another aspect of the invention, a method for driving the electron emission device composed as described above, wherein:

electric field between the anode electrode and the emitter is set as intermediate electric field between threshold electric field and electric field for maximum amount of current, In this driving method, the electric field between anode and cathode in set to be electric field applied most frequently, and the gate potential is modulated in both polarities of positive/negative. Thereby, time when the gate potential is at zero can be elongated, and the drive consumption power can be reduced. Also, the electric field between anode and cathode is set to be the intermediate electric field between threshold electric field and electric field for maximum amount of current. Thereby, the amplitude of gate, potential modulation can be minimized.

According to another aspect of the invention, a method for driving the electron emission device composed as described above, wherein:

electric field between the anode electrode and the emitter is set as electric field for maximum amount of current.

In this driving method, the gate modulation can be performed by only negative potential., therefore the composition of gate modulation circuit can be simplified. Also, when only zero potential occurs due to a failure in the gate modulation circuit, or when only floating potential occurs due to breaking of wire, the screen takes the maximum brightness, therefore the failures can be checked quickly. So, it can be utilized as temporary emergency lighting.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
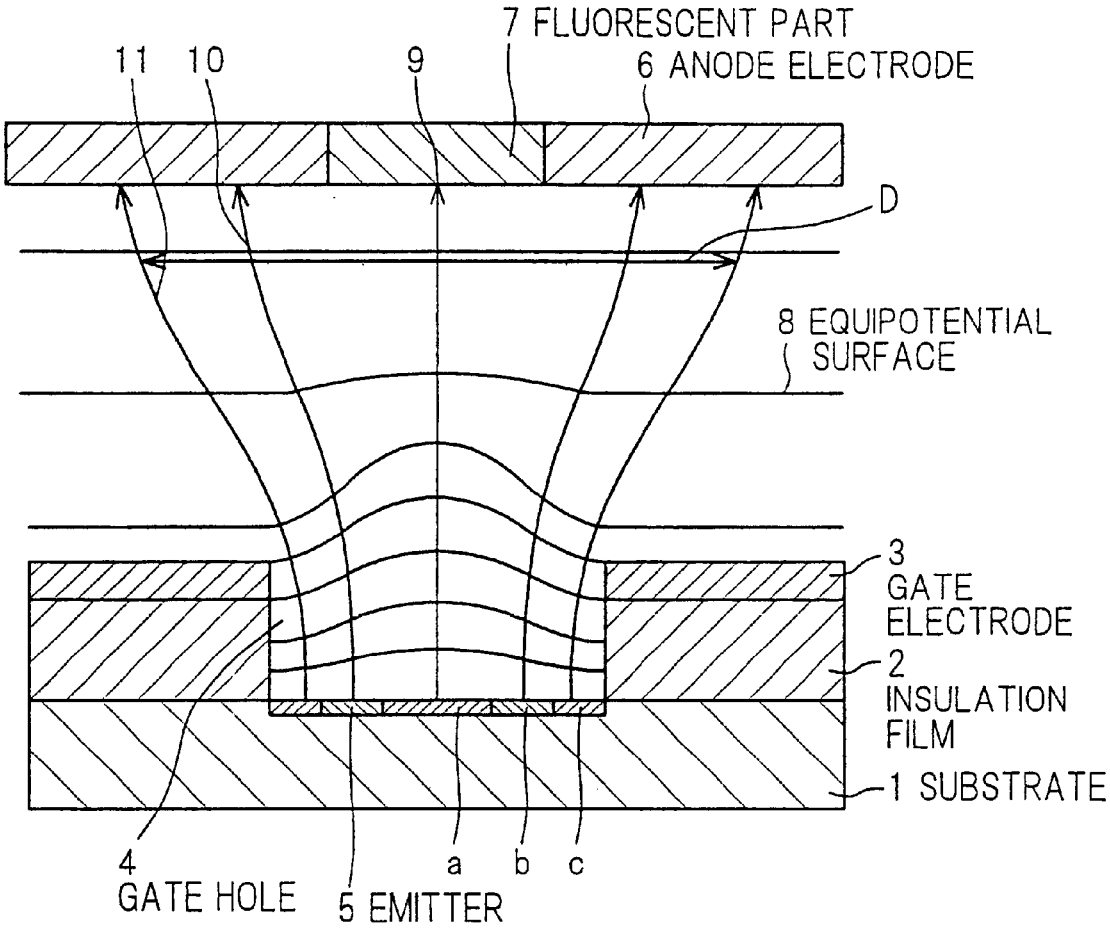
FIG. 1 PRIOR ART
FIG. 1 is a cross sectional view illustrating one picture element in the conventional FED.
Figure 2:
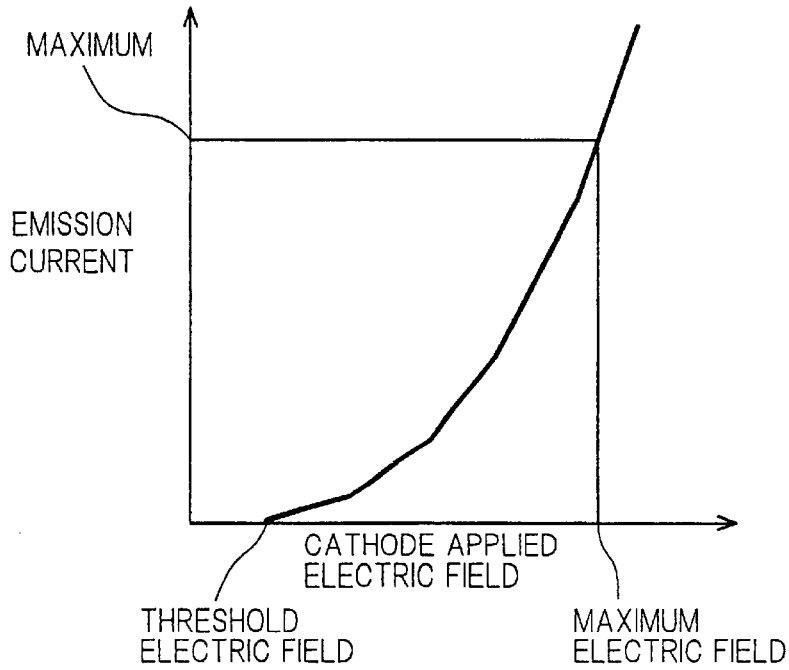
FIG.2 PRIOR ART
FIG. 2 is a graph showing the operation characteristic of the conventional electron emission device in FIG. 1.
Figure 3:
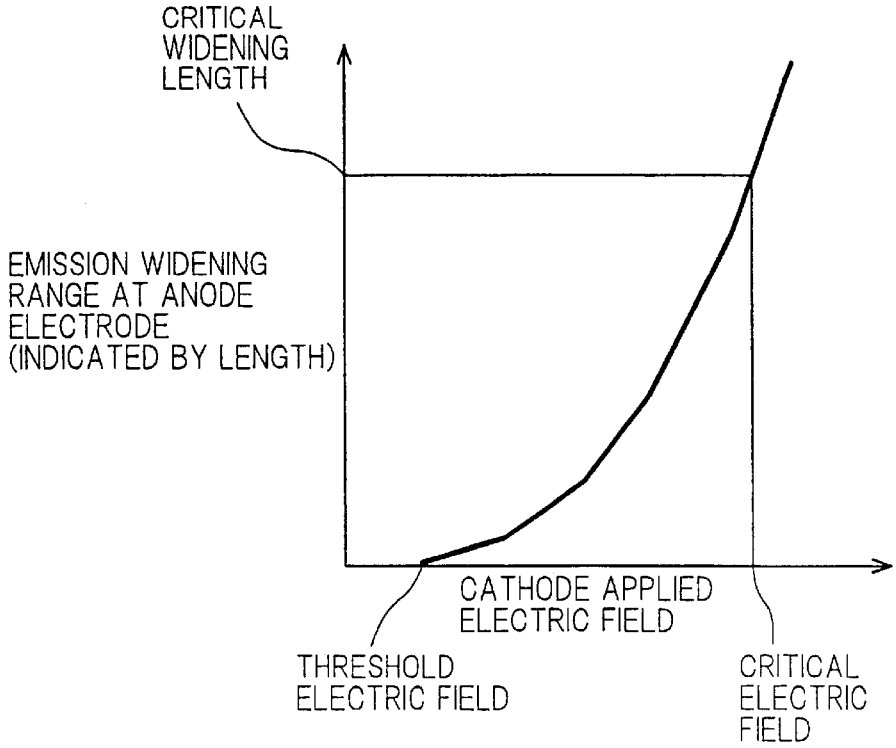
FIG.3 PRIOR ART
FIG. 3 is a graph showing the phenomenon (1) when the difference of electric field at the opening of gate hole is big.

The preferred embodiments of the invention will be explained below, referring to the drawings.

Figure 4:
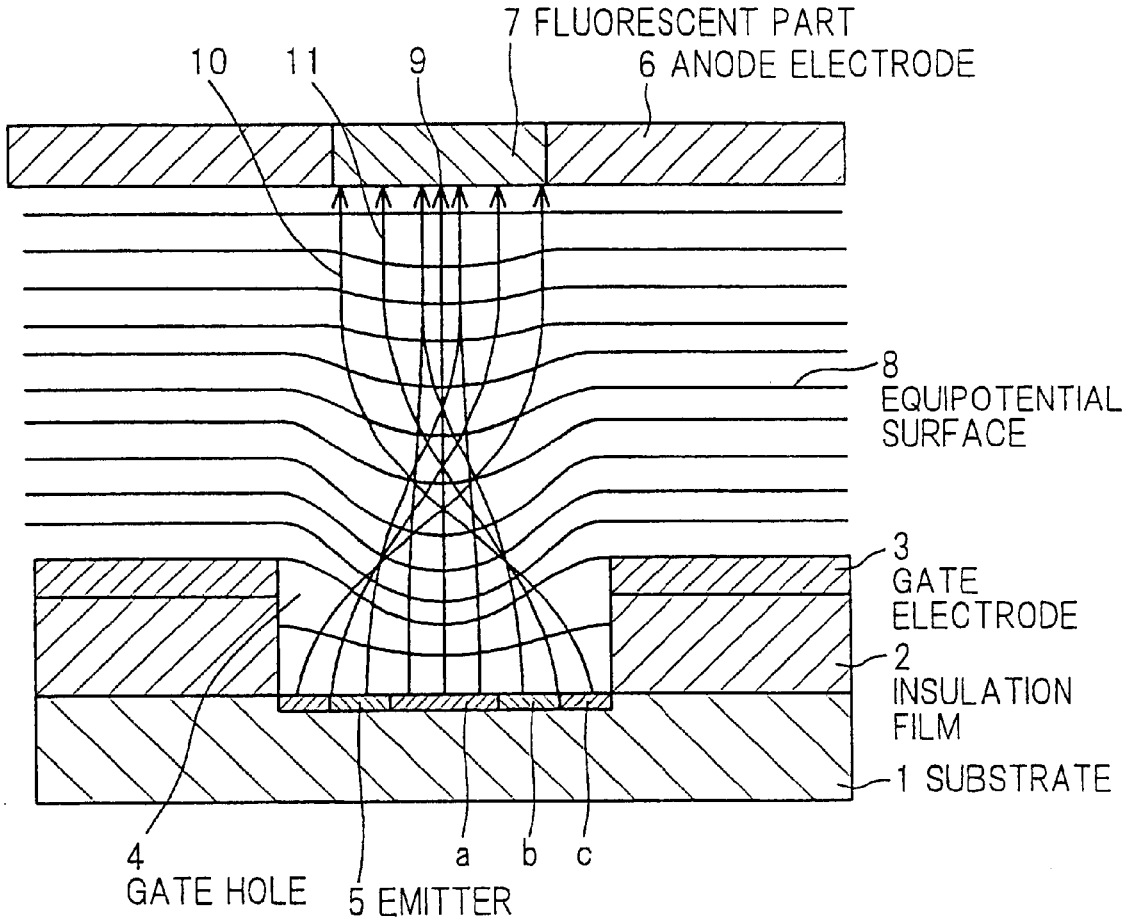
FIG. 4 is a cross sectional view showing schematically one picture element of FED as an electron emission device in a first preferred embodiment according to the invention, FIG. 5 in a graph showing the emission current density characteristic of the electron emission device in FIG. 1.

FIG. 4 is a cross sectional view showing schematically one picture element of FED as an electron emission device in the first preferred embodiment according to the invention.

As shown, insulation film of $SiO_2$ with a thickness of about 1 $\mu$m is deposited on substrate 1. Gate electrode 3 of aluminum with a thickness of about 200 nm is deposited an the insulation film 2. A tubular gate hole 4 is formed penetrating the gate electrode 3 and insulation film 2. Emitter 5 (hereinafter also referred to as cathode electrode) is formed with cathode material deposited on the substrate 1 at the bottom of the gate hole 4. Meanwhile, the emitter 5 may be buried under the insulation film 2 before forming the gate hole 4, or may be formed at the bottom after forming the gate hole 4.

As the cathode material of the emitter 5, carbon nanotube (hereinafter referred to an CNT) is used. CNT, which is a kind of fullerene, is a tubular crystal with inner diameter of several nm and can have a total length of more than 1 mm at the maximum. CNTs from the end of which a length of about 100 nm is collected are deposited iron metal film (not shown) on the substrate 1. This metal film is connected to wiring for yielding a cathode potential.

Anode electrode 6 is disposed around 1 mm above the gate electrode 3. Vacuum state is provided between the anode electrode 6 and the gate electrode 3. The degree of vacuum is set so that the emitter 5 can yield a desired characteristic. Remaining gas ionized by electrons may damage the emitter 5 or may cause breakdown of discharge by charging up the substrate 1. For example, by setting the degree of vacuum to be less than $1\times10^{-4}$ Pa, such a problem is eliminated.

Fluorescent material (part) 7 is coated on part of the anode electrode 6. Electrons plunge into the fluorescent part 7, exciting it to emit fluorescent light. The brightness of fluorescent light depends on the amount and the velocity of electron. On the surface of the fluorescent part 7 where electrons plunge into, about 50 nm aluminum deposition film is formed. This aluminum film is provided to protect the electron-plunging surface from the electron damage or negative ion damage, and to reflect fluorescent light toward the back side (viewing face) of the aluminum film.

For example, when applying 3 kV to the anode electrode 6 and fluorescent part 7. 2 V to the gate electrode 3 and 0 V to the emitter 5, equipotential surface 8 existing between the anode electrode 6 and the gate electrode 3 and between the anode electrode 6 and the gate hole 4 is shaped into a concave convergence lens being caved at the corresponding position of the gate hole 4 (FIG. 4). Lines to indicate the equipotential surface 8 are conceptualized and do not always correspond to the actual equipotential surface 8, but the tendency to be caved is common.

When dividing the emitter 5 at the bottom of the gate hole 4 concentrically into regions a, b and c, electron. 9 emitted from region a goes straight nearly directly above, and electron 11 emitted from region b outside region a plunges into the fluorescent part 7 while being a little over-focused. Electron 10 emitted from region c outside region b plunges into the fluorescent part 7 while being over-focused earlier than electron 11. Thus. All electrons plunge into within the range of the fluorescent part 7. Herein, focusing is defined assuming the existence of a convergence axis of circular hole lens, when regarding the equipotential surface 8 near the gate hole 4 as the circular hole lens. In this case, there are three states, i.e., under-focusing, just-focusing and over-focusing. The under-focusing is defined as a state before electron crosses the convergence axis, the just-focusing is defined as a state that electron tracks on the convergence axis, and the over-focusing is defined as a state that electron crosses the convergence axis and exceeds it.

Figure 5:
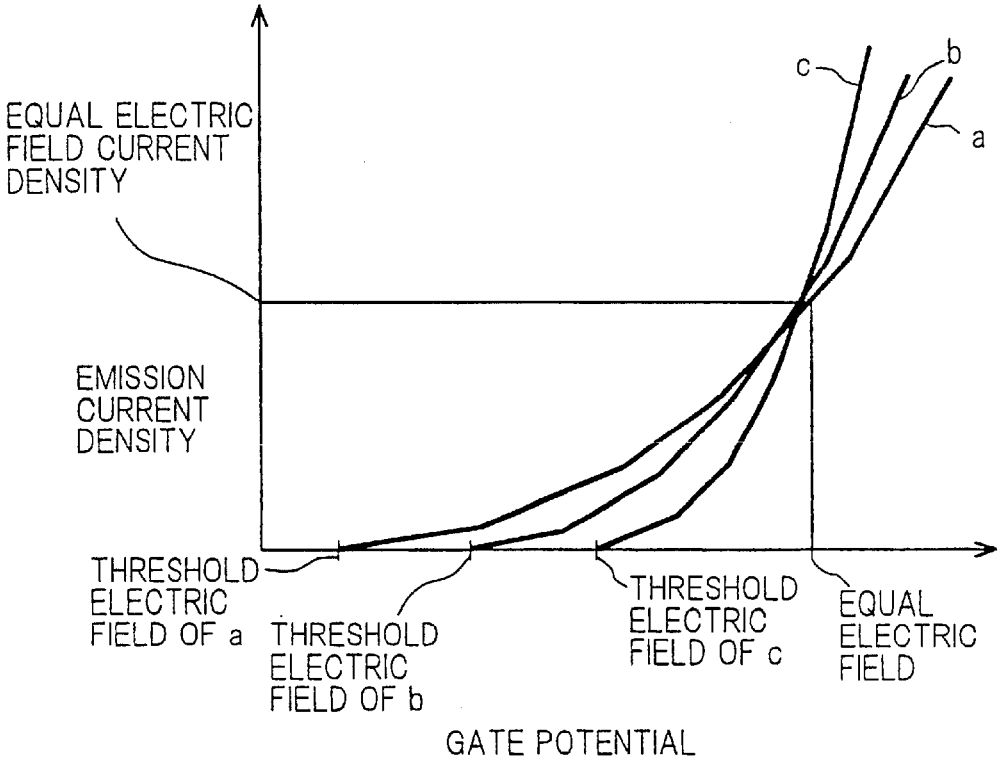
Figure 6:
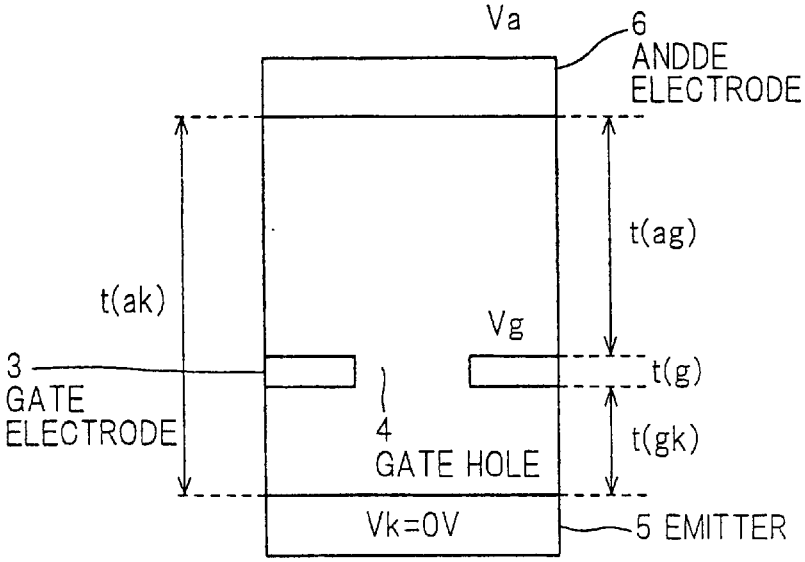
FIG. 6 is an illustration showing a case that equipotential surface is formed concave in a specific range.

The state in FIG. 1. Is detailed referring to FIGS. 5. FIG. 5 is a graph showing the emission current density characteristic of the electron emission device in FIG. 1. With regard to three regions a, b and c, the gate potential dependency is shown.

In FIG. 5. In region a that is nearest to the convergence axis, the influence by changing the potential of the gate electrode 3 is smallest. When electrons are emitted in electric field toward the anode electrode 6 being separated about 1 mm and applied a voltage of 3 kV from the emitter 5, the controls of (A) suppressing the emission of electron, (a) not affecting the emission of electron and G accelerating the emission of electron can be switched by altering a voltage applied to the gate electrode 3.

When the potentials of the anode electrode 6 and the cathode electrode 5 are 0 V, to apply a voltage of 3 V to the gate electrode 3 corresponds to the control (B) of not affecting. In this state of control, the case that a gate potential exists is called equal electric field. In case of a gate potential of less than 3V, the control is suppressing, and in case of a gate potential of more than 3, the control in accelerating. The emission characteristics of three regions a, b and c are all equal at the state of equal electric field. The emission currant density in this state is called equal electric field current density. As shown in FIG. 5 the characteristics of three regions a, b and c each have different threshold values, and the order of intensity among them is inverted at the equal electric field. In the example in FIG. 4, the maximum electric field to got the maximum amount of current is set to be yielded at a gate potential of 2 V. This 2 V corresponds to a case that electric field between the gate electrode 3 and the emitter 5 is less than the equal electric field.

In FIG. 4 only the Partial structure (part of picture element) of FED as the electron emission device is shown. Now the entire structure is explained below. The FED display is created by arraying the picture elements two-dimensionally like a matrix. Various methods to supply picture element signal to the respective picture elements arrayed two-dimensionally can be employed. As an example, a simple matrix type is explained. In this example, strips of gate electrodes 3 are arrayed and emitters 5 are arrayed in the direction of orthogonal to the gate electrode 3. In FED, the base member of the anode electrode 4 is of glass, and ITO conductive film is deposited on the lover surface (surf ace on the vacuum side) of the glass member. On the ITO surface, further films are deposited in the order of fluorescent part and aluminum film.

Now a case that the equipotential surface is shaped into a concave form in a range that cannot be defined by only the relationship of electric field based on a gate lower-surface potential is explained For example, in the conventional electron emission device explained in FIG. 1, because the equipotential surface and over-focusing is not considered, the size of anode electrode target region may become wider than that of the cathode electrode 5 at the bottom of the gate hole 4.

At first, the equipotential surface is considered. Herein, assumed is a triode structure shown in FIG. 1, where anode electrode 6 and cathode electrode 5 are disposed as parallel plates and gate hole 4 is formed between them. Meanwhile, the distance between the surface of cathode electrode 5 and the back surface of gate electrode 3 is t(gk), the distance between the back surface of anode electrode 6 and the surf ace of cathode electrode 5 is t(ak), the potential of anode electrode 6 is Va, the potential of gate electrode 3 is Vg, the thickness of gate electrode 3 is t(g), the distance between the back surface of anode electrode 6 and the surface of gate electrode 3 is t(ag), and the potential of cathode electrode 5 is Vk. By defining Vk=0 [V], expressions below are simplified.

When the thickness of gate electrode t(g)>0, in order to enable the equipotential surface near the gate hole 4 to have a concave shape, it is necessary to satisfy the following expression.

$$Va/t(ak) \geqq Vg/t(gk) \tag{1}$$

Expression (1) is then modified into the next expression.

$$Vg \leqq \{t(gk)/t(ak)\} \cdot Va \tag{2}$$

On the other hand, in order to enable the equipotential surface near the gate hole 4 to have a convex shape, it is necessary to satisfy the following expression.

$$Va/t(ak) \geqq (Va-Vg)/t(ag) \tag{3}$$

When the positions of anode electrode 6 and emitter 5 are reversed, the same situation as expression (1) is obtained. Here, modifying expression (3) by inserting the next relation:

$$t(sg)=1(ak)-t(g)-t(gk).$$

the next expression is obtained.

$$Vg \geqq [\{t(g)+t(gk)\}/t(ak)] \cdot Va \tag{4}$$

The region undefined by expressions (2) and (4). Is defined by:

$$\{t(gk)/t(ak)\} \cdot Va < Vg < [\{t(g)+t(gk)\}t(ak)] \cdot Va \tag{5}$$

The equipotential surf ace in this region has a convex shape from the cathode electrode 5 to the gate electrode 3, and changes into a concave shape gradually in the range of the thickness of gate electrode 3.

An equipotential-surface inclination point of view to define a concave/convex shape can be classified into three regions defined by expressions (2), (4) and (5).

Figure 7:
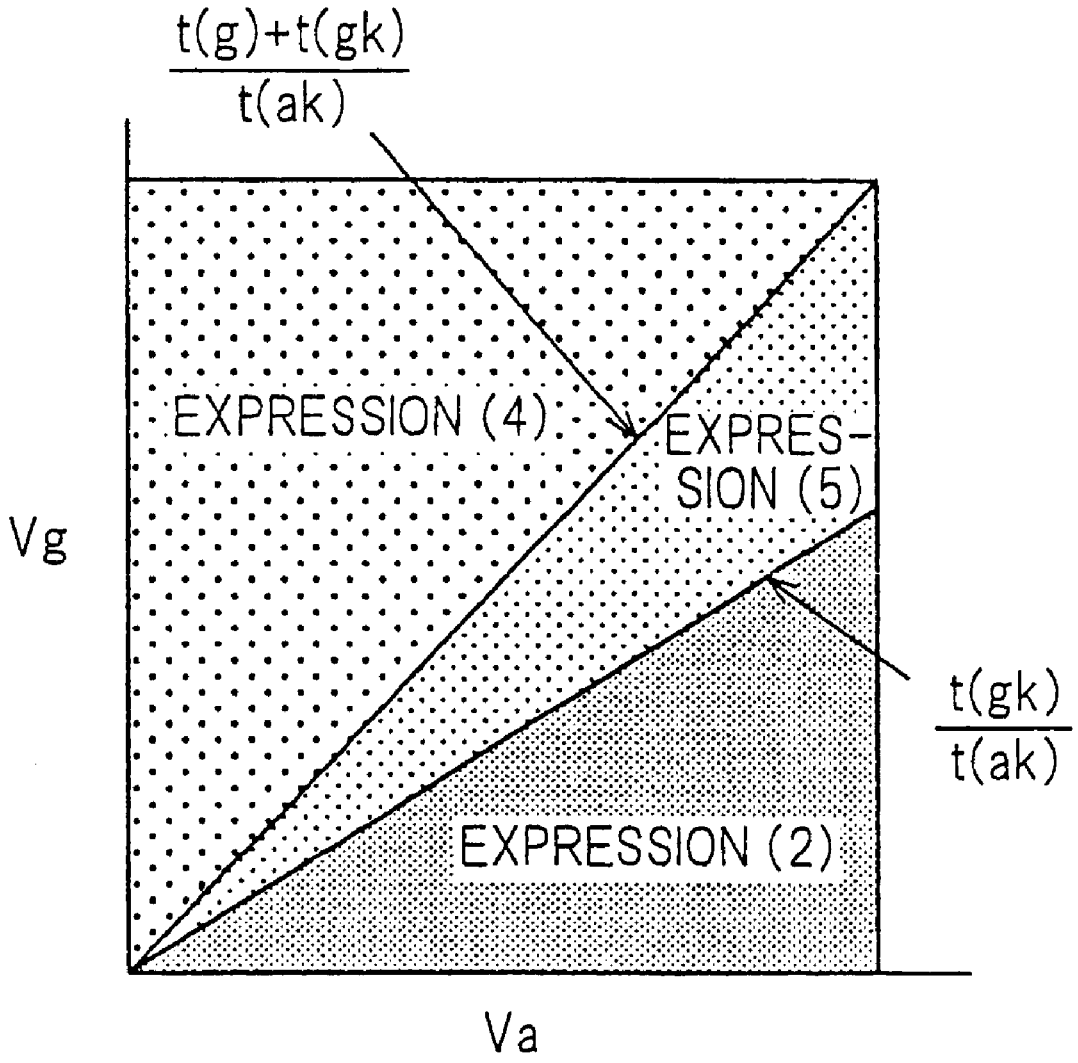
FIG. 7 is a graph showing three regions defined by expressions (2), (4) and (5)

FIG. 7 is a graph showing the three regions defined by expressions (2), (4) and (5). In FIG. 7, the respective regions defined by expressions (4), (5) and (2) are contacting together in this order. In the region by expression (2), electrons emitted from the cathode electrode 5 are subject to the function of concave, i.e., convergence lens from the equipotential surface.

Here, in order to help the understanding, the situation of $Vg=\{t(gk)/t(ak)\}\cdot Va$ at the boundary is explained. For example, if the thickness of gate electrode 3 is zero, then the equipotential surface is formed in parallel to the cathode electrode 5 and the anode electrode 6. However, in fact, since the gate electrode 3 has a thickness, as much as this thickness interrupts, the equipotential surface inside the gate hole 4 sinks under the gate electrode 3, thereby yielding a concave equipotential surface.

In the region by expression (4), viewing from the cathode electrode 5, a convex equipotential surface is formed. But, viewing from the anode electrode 6, a concave equipotential surface is formed. This is the case that the situation by expression (2) is reversed.

In the region by expression (5), there exists electric field equal to Va/t(ak) (hereinafter referred to as anode electric field) inside the gate electrode 3 (gate hole 4) with a thickness. The electric field between the back surface of gate electrode 3 and the surface of cathode electrode 5 is more intensive than the anode electric field and yields a dense equipotential surface. So, the equipotential surface on the cathode electrode 5 side rather than the anode electric field becomes convex.

Figure 8:
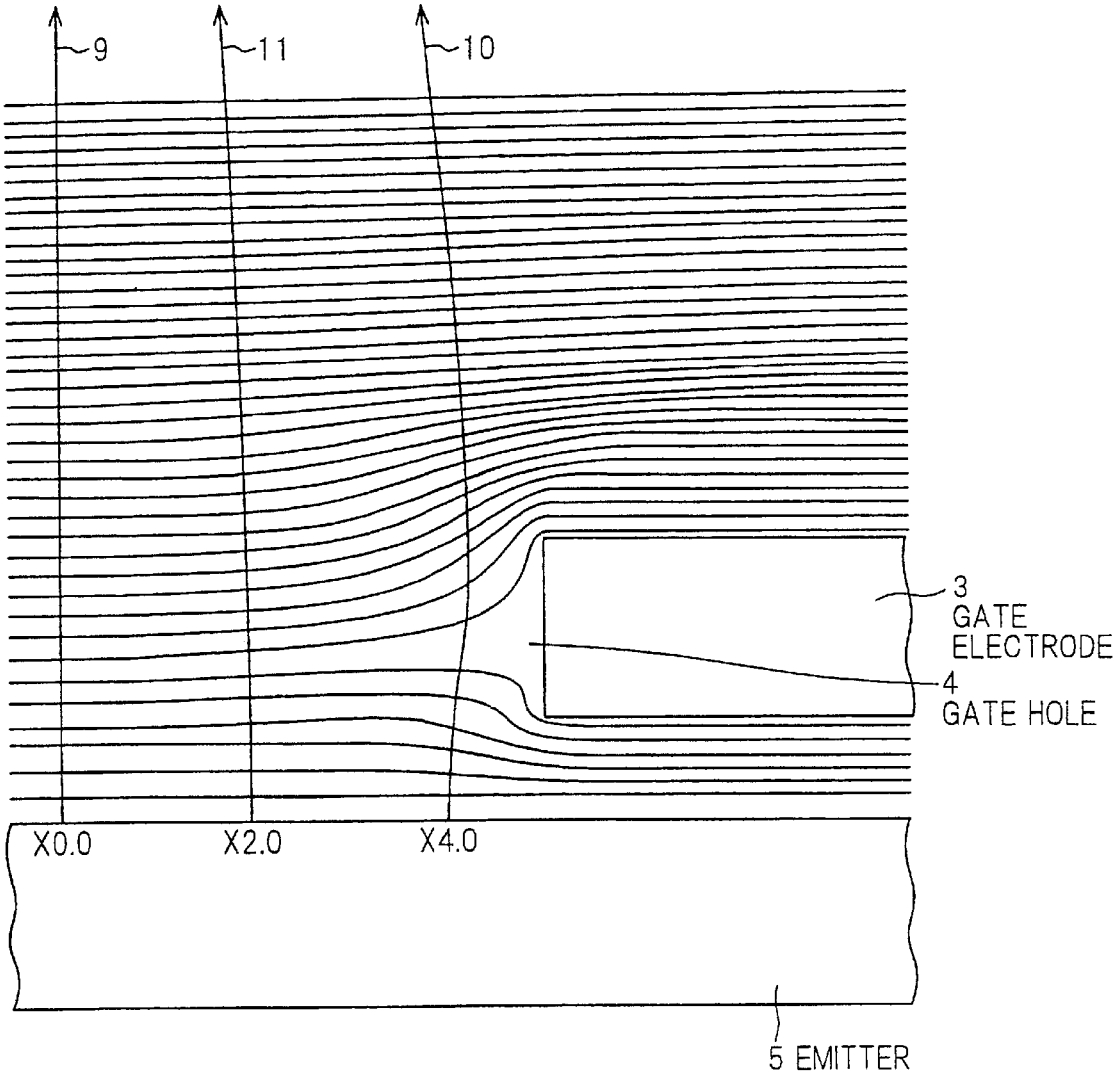
FIG. 8 shows the result of simulating the lens effect of equipotential surface by expression (5).

FIG. 8 shows the result of simulating the lens effect of equipotential surface by expression (5). Of electrons emitted from the cathode electrode 5, electron 9 emitted from X coordinate of 0.0 at the center of gate hole 4 goes straight toward the anode electrode (not shown) upward in FIG. 8, electron 11 emitted from X coordinate of 2.0 a little outside the center travels a little inclined to the center axis side by convergence type lens effect, after passing the junction plans of concave and convex equipotential surfaces. Electron 10 emitted from X coordinate of 4.0 closer to the gate electrode 3 than electron 11 travels a little curved in the direction of departing from the center axis until passing the junction plane of concave and convex equipotential surfaces. But, after passing the junction plane, it travels curved in the direction of converging on the center axis by the convergence lens effect of concave type equipotential surface. In FIG. 8, the potential difference between neighboring equipotential surfaces is about 0.1 V.

On the other hand, on the anode electrode 6 side rather than the anode electric field, the electric field between the surface of gate electrode 3 and the back surface of anode electrode 6 is more intensive than the anode electric field and yields a dense equipotential surface. So, the equipotential surf ace becomes concave. Electron emitted from a position deviated from the center of cathode electrode 5 travels converging on the center axis side along the direction orthogonal to the concave type equipotential surface, and travels being diverged outward by the over-focusing at the high position.

Next, the target region that electrons plunge into the anode electrode 6 is considered. At first, when the circular hole lens functions as a divergence lens, the target region becomes wider than the emitter region at the bottom of gate hole 4 and is never narrower than that. On the other hand, when the circular hole lens functions as a convergence lens, the target region becomes wider or narrower than or the same as the emitter region, as the case may be. Whether the target region becomes wider or narrower cannot be determined by only the definition of electric field made in the consideration of equipotential surface. For example, in both cases that a voltage of 1 kV is applied while departing 1 mm the anode electrode 6 from the emitter 5, and that a voltage of 10 kV is applied while departing 10 mm the anode electrode 6 from the emitter 5, electric field of 1 kV/mm can be obtained. However, for electron passing the convergence lens system, the target region can be narrower due to before or just after the over-focusing when the distance between the cathode and anode electrodes is 1 mm, or the target region can be wider due to the sufficient over-focusing when the distance between the cathode and anode electrodes is 10 mm.

The above matters are summarized in Table 1.

TABLE 1

| Expression | Near the gate electrode | Target region |
|---|---|---|
| (2) | Concave type equipotential surface | Wider or narrower |
| (5) | Junction plane of concave and of concave and convex equipotential surface | Wider or narrower |
| (4) | Convex type equipotential surface | Wider |

The second preferred embodiment of the invention will be explained below.

Figure 9:
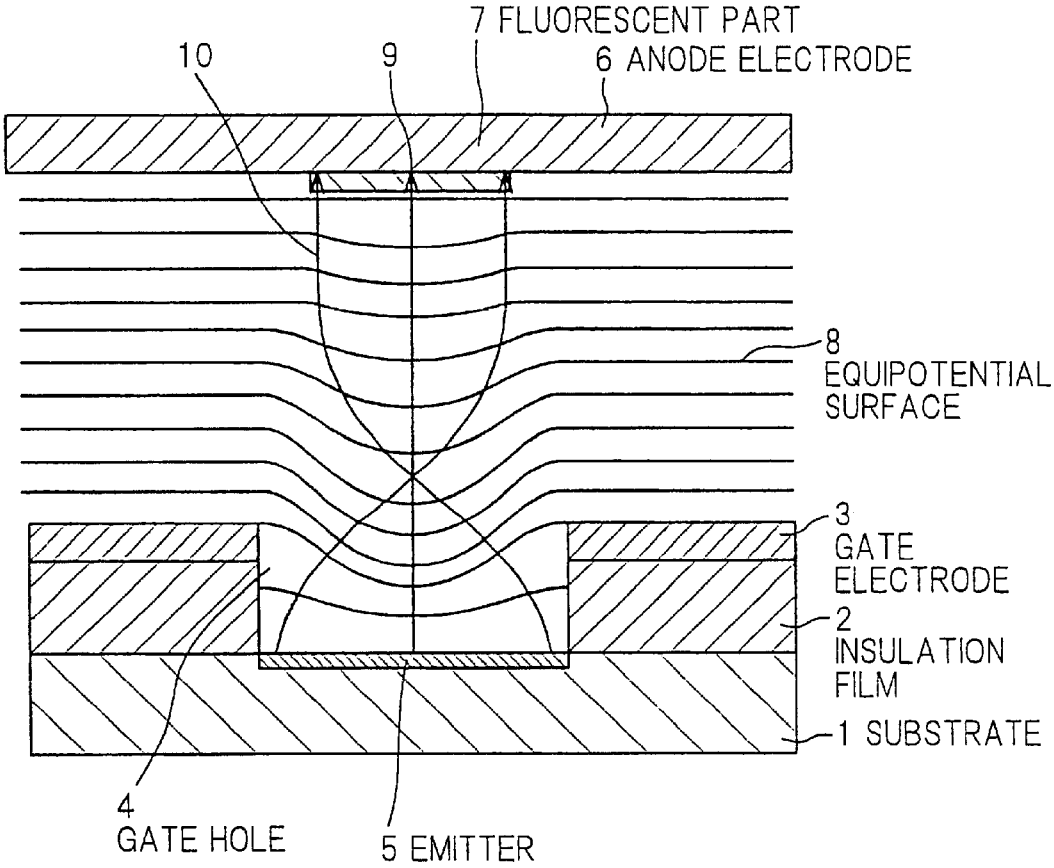
FIG. 9 is a cross sectional view showing schematically one picture element of FED as an electron emission device in a second embodiment according to the invention.
Figure 10:
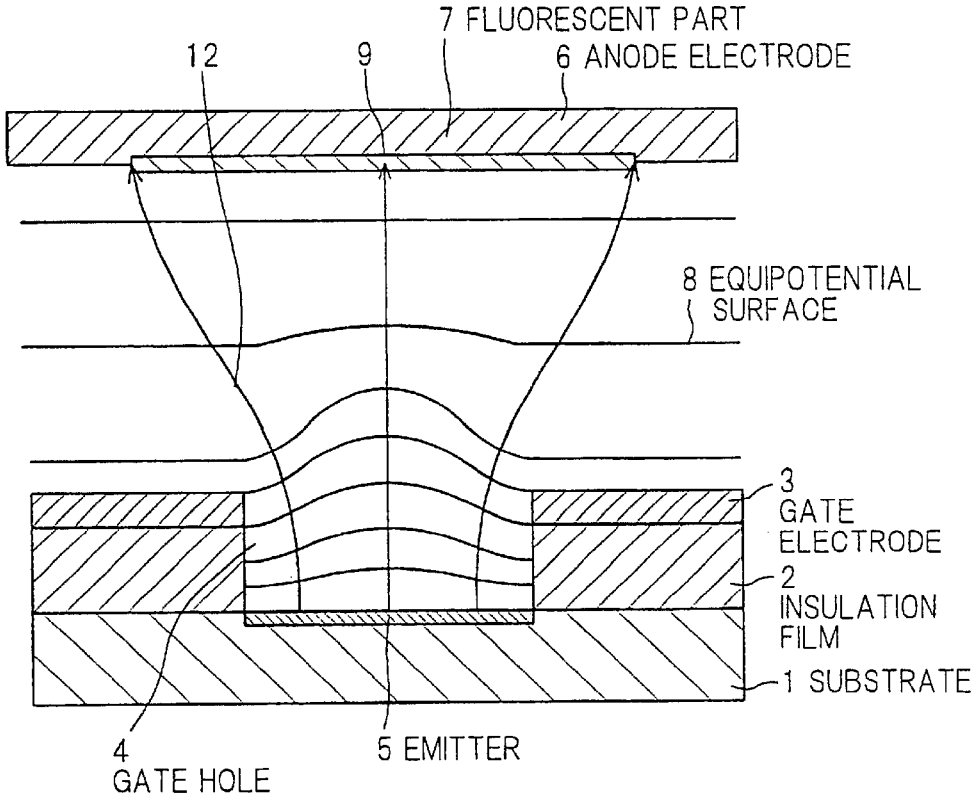
FIG. 10 is a cross sectional view showing electron emission tracks in a case that the electric field between gate electrode and cathode electrode is more intensive than the electric field between anode electrode and gate electrode in the second embodiment.

FIG. 9 is a cross sectional view showing one picture element in electron emission device in the second embodiment according to the invention, where emission electrons are illustrated by altering the illustration manner in FIG. 4. FIG. 10 is a cross sectional view showing electron emission tracks in a case that the electric field between gate electrode and cathode electrode is more intensive than the electric field between anode electrode and gate electrode. FIGS. 9 and 10 show typical cases of convergence (suppression) and divergence (acceleration), respectively.

In FIG. 9, shown are only electron 10 emitted from the outside of cathode electrode 5 deposited at the bottom of gate hole 4, and electron 9 emitted form the center. The electric field between gate electrode 3 and cathode electrode 5 is set to be smaller than the electric field between anode electrode 6 and gate electrode 3. Thereby, the electric field formed inside the gate hole 4 and in its vicinity yields a lens effect to enable electron emitted to the anode electrode 6 to be converged. Therefore, electrons plunge into the anode electrode 6 while being over-focused. This over-focusing state does not always occur, and occurs only when the convergence effect is significant. When the state is approximate to equal electric field, electrons plunge into the anode electrode 6 while being under-focused or just-focused.

On the other hand, in FIG. 10, the electric field between gate electrode 3 and cathode electrode 5 is set to be greater than the electric field between anode electrode 6 and gate electrode 3. Thereby, the electric field formed inside the gate hole 4 and in its vicinity yields a lens effect to enable electron emitted to the anode electrode 6 to be diverged. Therefore, electrons 12 emitted from the circumference of lens plunge into the anode electrode 6 while being diverged outward.

Figure 11:
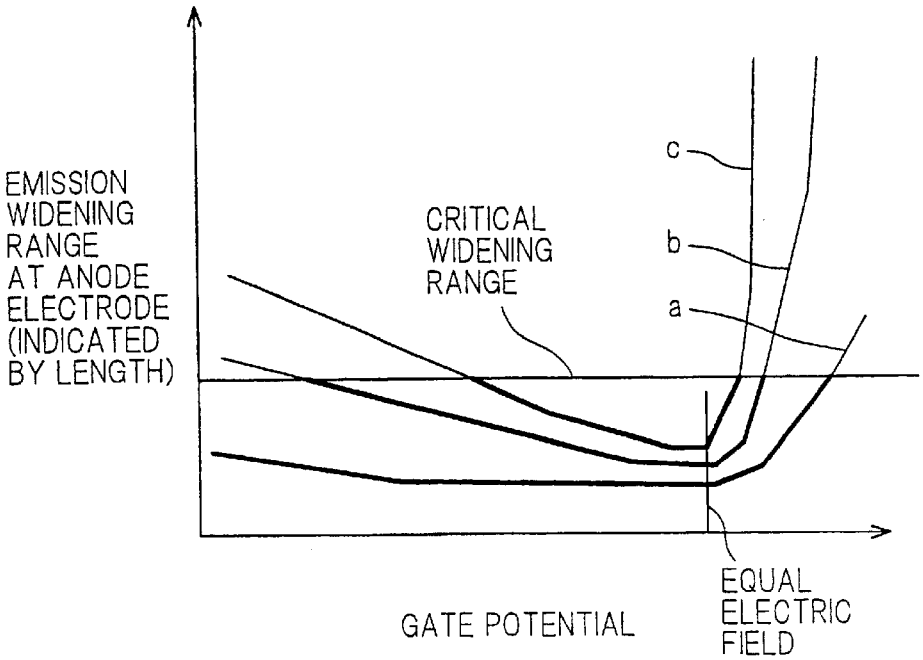
FIG. 11 is a graph showing the emission-widening characteristics including the states of convergence and divergence in the second embodiment.

FIG. 11 is a graph showing the emission-widening characteristics including the states of convergence and divergence. In FIG. 11, shown are the emission-widening characteristics at the time when electrons from regions a, b and c (See FIG. 4) plunge into the anode electrode 6. The vertical axis of the graph indicates the emission-widening range when plunging into the anode electrode 6, and the lateral axis indicates the potential of gate electrode 3. Length D means a diameter in the measurement of maximum widening range (FIG. 1).

At equal electric field, electrons emitted from regions a, b and c go almost straight without being affected by the lens effect. The reason why the length D of widening range is not zero is that regions a, b and c each have its own size and the initial speed is not completely zero. In the graph, at the border of critical widening range on the target region, the curves change from heavy curve to thin curve.

In the range of less than equal electric field, the electron tracks are curved in the convergence direction. When the gate potential reduces and the degree of over-focusing increases, the widening range D increases. The degree of the increased widening range is biggest for emission of region c near the circumference. On the other hand, when the gate potential is greater than the equal electric field, the circular hole lens functions as a divergence lens. Therefore, the widening range D increases steeply with a rise in gate potential. Especially, for region c, it increases most steeply.

In FIG. 11, resultingly, the widening characteristics have minimum values near the equal electric field. Strictly speaking, when the gate potential is smaller than the equal electric field, the minimum values are yielded by the convergence effect worked properly. By setting the critical widening range as shown in FIG. 11, the conditions for gate potential to satisfy the widening range condition are determined. In FIG. 11, the ranges to satisfy the widening condition are indicated by heavy curves. When the emission from regions a, b and c are on the heavy curves, the widening condition at the anode electrode 6 is satisfied. In this embodiment, good emission-widening characteristics can be obtained by setting the potential in the range of the heavy curves that do not exceed the critical widening range.

Figure 12:
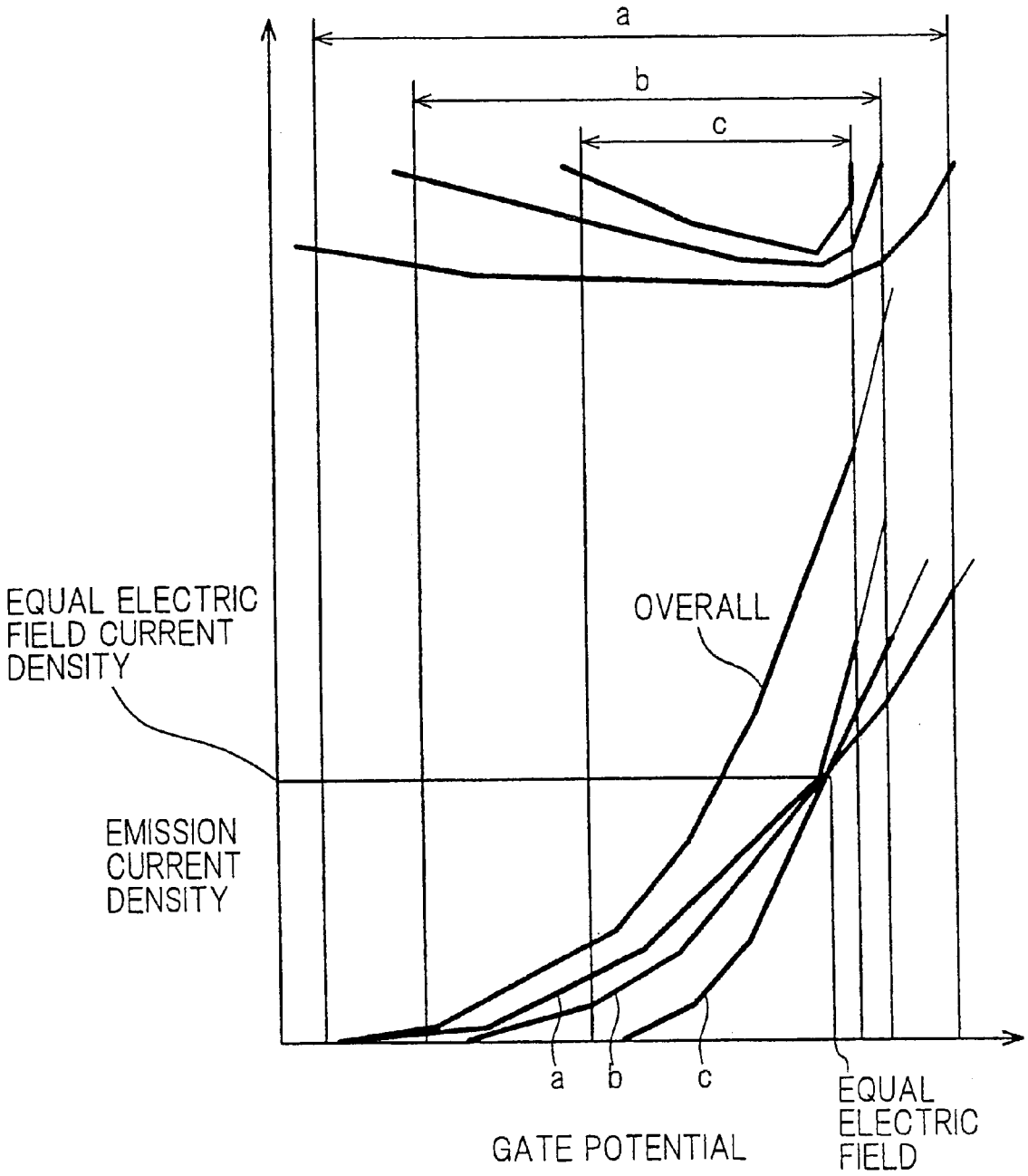
FIG. 12 is a graph overlapping the condition range for widening characteristics with the emission current density characteristics in the second embodiment.

FIG. 12 is a graph overlapping the condition range for widening characteristics with the emission current density characteristics. The results in FIG. 11 are shown in the upper part of the graph. The ranges to satisfy the conditions for regions a, b and c are indicated by arrows a, b and c in the top part. The emission current density characteristics to gate potential are shown in the lower part of the graph.

The condition-satisfying ranges in FIG. 11 are shown by the heavy curves in the upper part of the graph in FIG. 12. In the range of less than the equal electric field, all regions satisfy the widening conditions in the entire range of greater than the respective threshold electric fields. In the range of greater than the equal electric field, the range up to the potential (right end of arrow c to indicate the condition range of range c) that deviates from the condition at the lowest gate potential satisfy the condition. In this embodiment, the range up to this potential is used as the drive region. The amount of emission current by synthesizing three regions a, b and c is shown by a label "overall". Only this curve represents the amount of current, not the current density.

Figure 13:
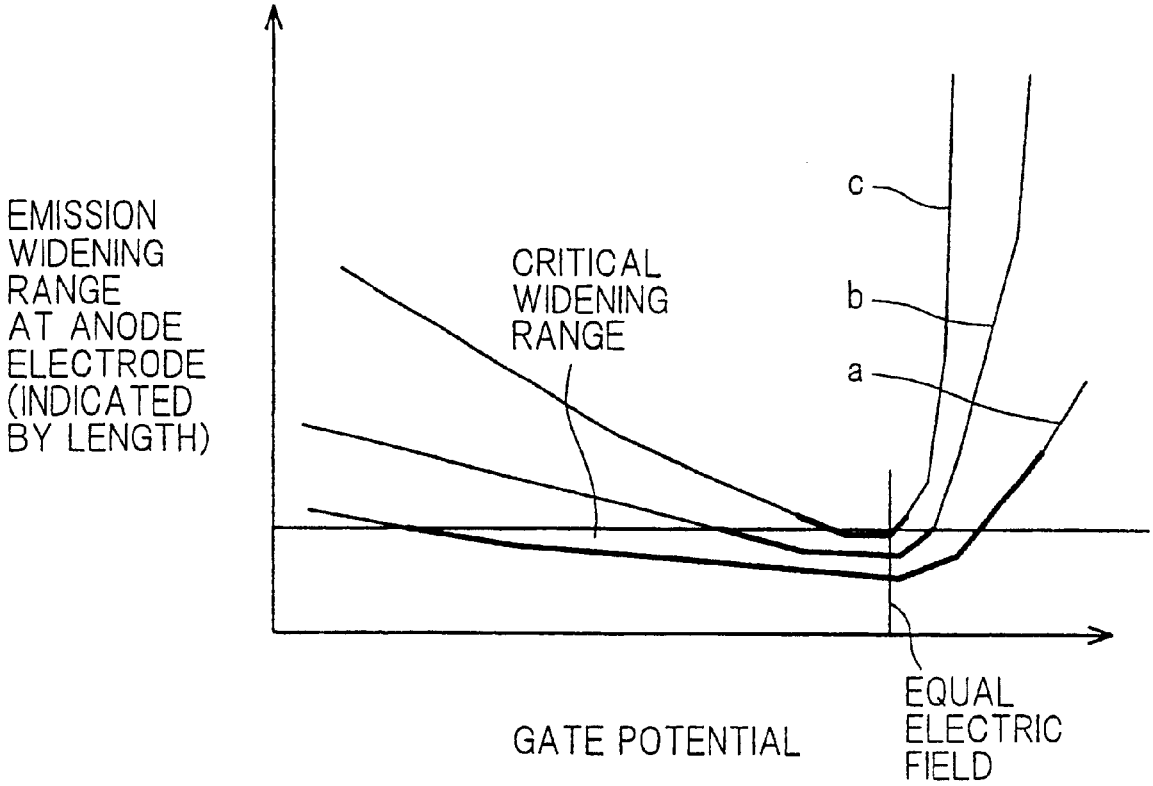
FIG. 13 is a graph showing the widening characteristics in a third preferred embodiment according to the invention.

The third preferred embodiment of the invention is explained. FIG. 13 is a graph showing the widening characteristics that have the minimum value near the equal electric field, like the case in FIG. 11. In this graph, the critical widening range is defined more strictly than that in FIG. 11. As a result, the condition-satisfying ranges indicated by heavy curves are narrower than those in FIG. 11.

Figure 14:
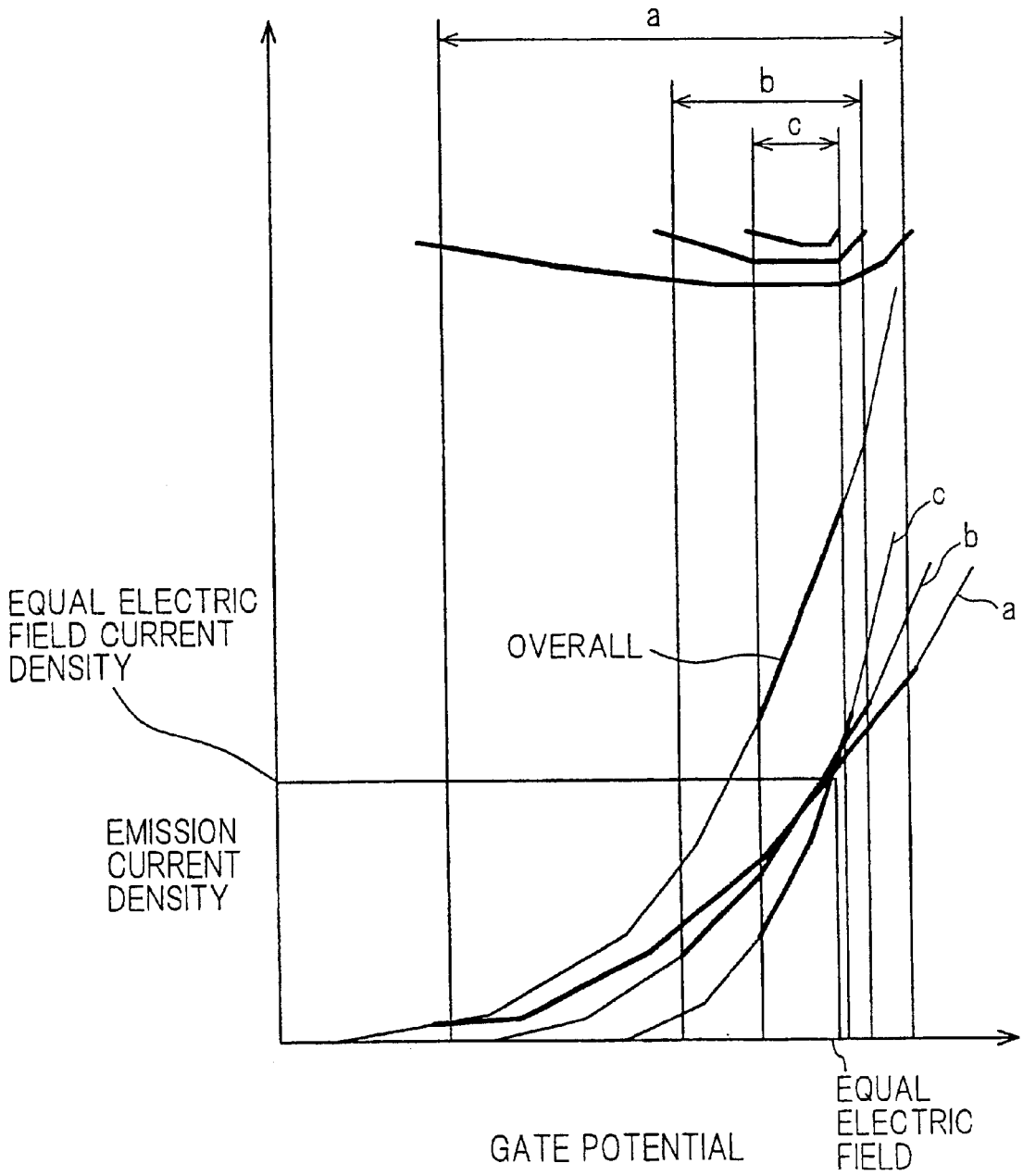
FIG. 14 is a graph overlapping the condition range for widening characteristics with the emission current density characteristics in the third embodiment.

FIG. 14 is a graph overlapping the condition range for widening characteristics with the emission current density characteristics, like FIG. 12. In this graph, under the influence of setting strictly the critical widening range, the lower limit and upper limit of the overall amount of emission current are determined. So, when the gate potential is set to have an amount of current less than the lower limit, the widening characteristics becomes bad. The electron emission device having this characteristics needs such a strategy that increases the attenuation of electron to arrive at the fluorescent part 7 by thickening the aluminum deposition film covering the electron-plunged plane of fluorescent part 7, or that uses fluorescent part 7 having fluorescent characteristics including a low threshold of sensitivity.

Figure 15:
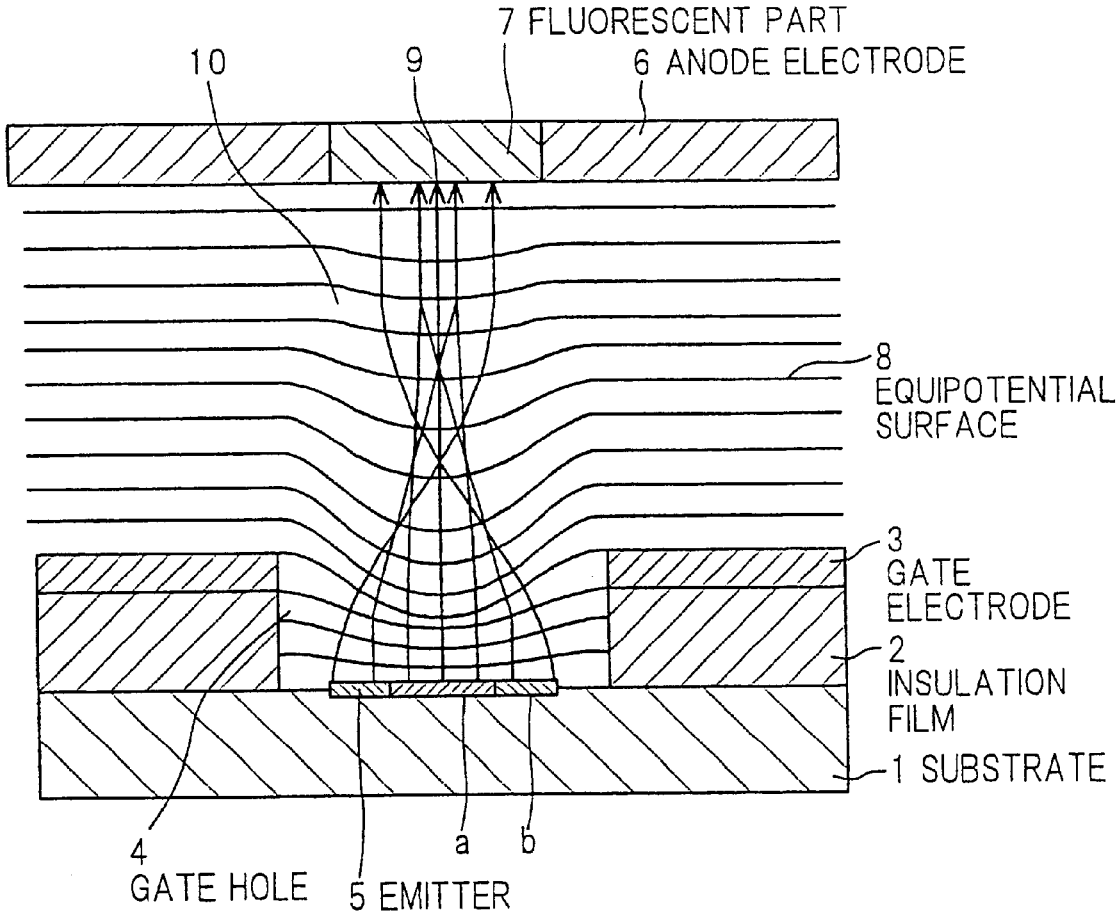
FIG. 15 is a cross sectional view showing schematically one picture element of FED as an electron emission device in fourth and sixth preferred embodiments according to the invention.

The fourth preferred embodiment of the invention is explained. FIG. 15 shows an example that region c of the emitter 5 in the electron emission device in FIG. 4 is removed to offer the emitter 5 narrower than the inner diameter of gate hole 4. Referring back to the graph in FIG. 14, the characteristic of the electron emission device in FIG. 15 are explained. In this embodiment, by removing region c, the range to satisfy the conditions that electrons plunge into the fluorescent part 7 in good widening characteristics can be increased.

Figure 16:
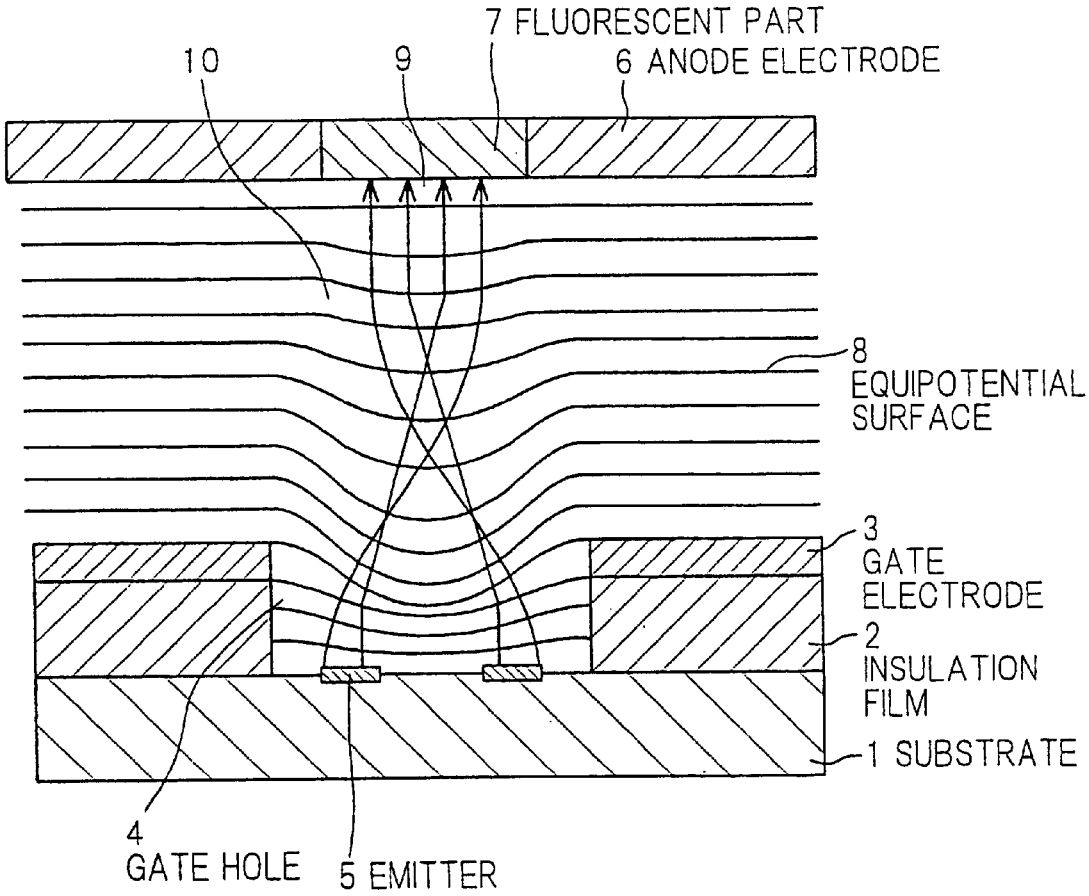
FIG. 16 is a cross sectional view showing schematically one picture element of FED as an electron emission device in a fifth preferred embodiment according to the invention.
Figure 17:
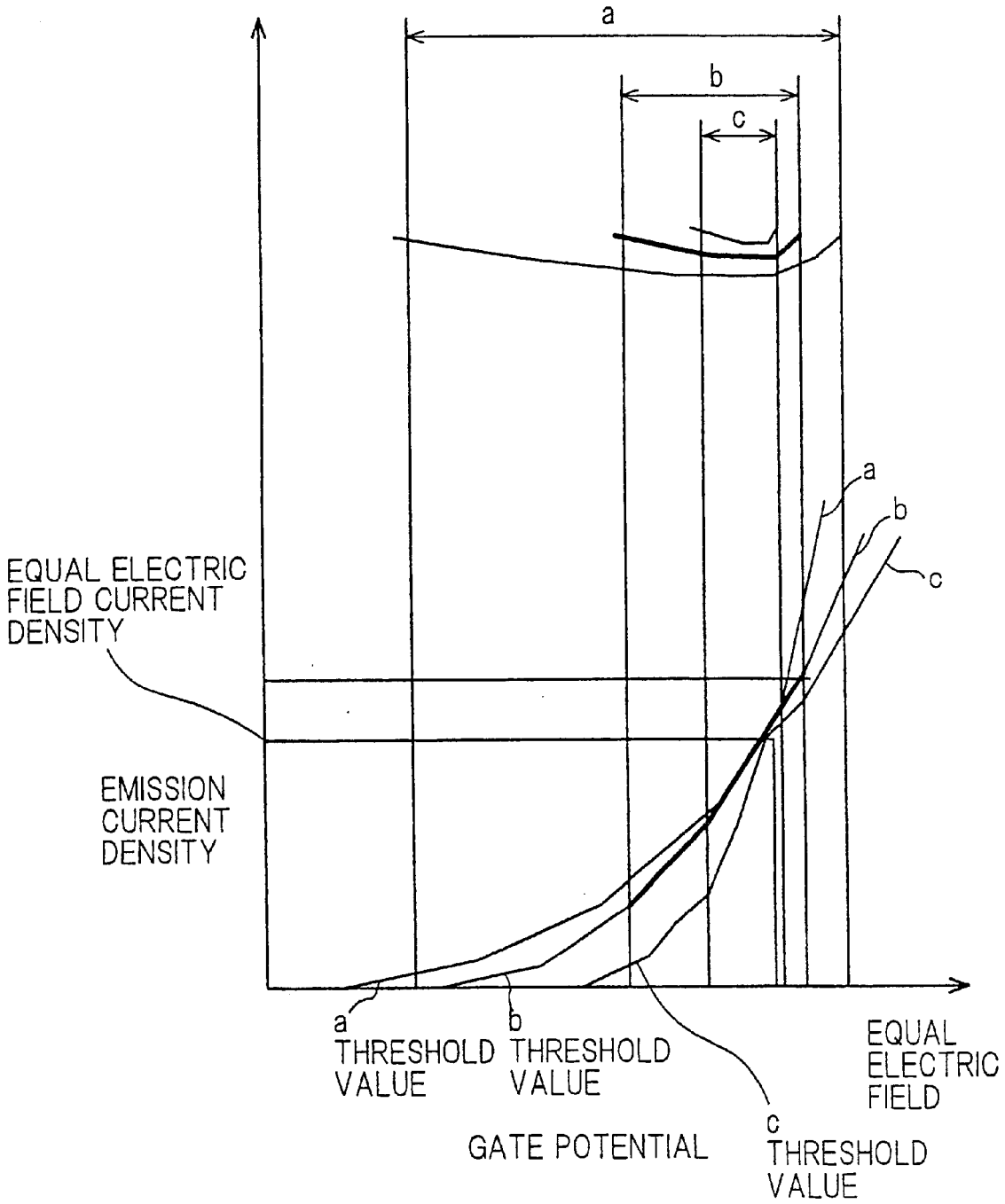
FIG. 17 is a graph showing characteristics for emitter 5 formed only on region b in the fifth embodiment.

The fifth preferred embodiment of the invention is explained. FIG. 16 shows an example that ring-shaped emitter 5 is provided by depositing cathode material only on region b in FIG. 4. FIG. 17 is a graph showing characteristics for the emitter 5 formed only on region b. By providing the emitter 5 only on region b, the maximum emission current density can be increased sufficiently and the minimum amount of emission current can be reduced sufficiently. As a result, the display gradation can be widened. Also, since region a with a low sensitivity to the change of gate potential is removed, the amount of emission current density varies steeply to the change of gate potential. Thus, the display gradation can be controlled widely by using the change of gate potential with small amplitude.

Referring back to FIG. 15, the sixth preferred embodiment of the invention is explained. In this embodiment, cathode material for region a is provided with a higher work function than cathode material for region b. As a result, the amount of electrons to excite the center of fluorescent part 7 reduces, and therefore electrons shoot relatively uniformly the entire surface of fluorescent part 7. Thereby, the phenomenon that part of fluorescent part 7 deteriorates by burning can be prevented.

Figure 18:
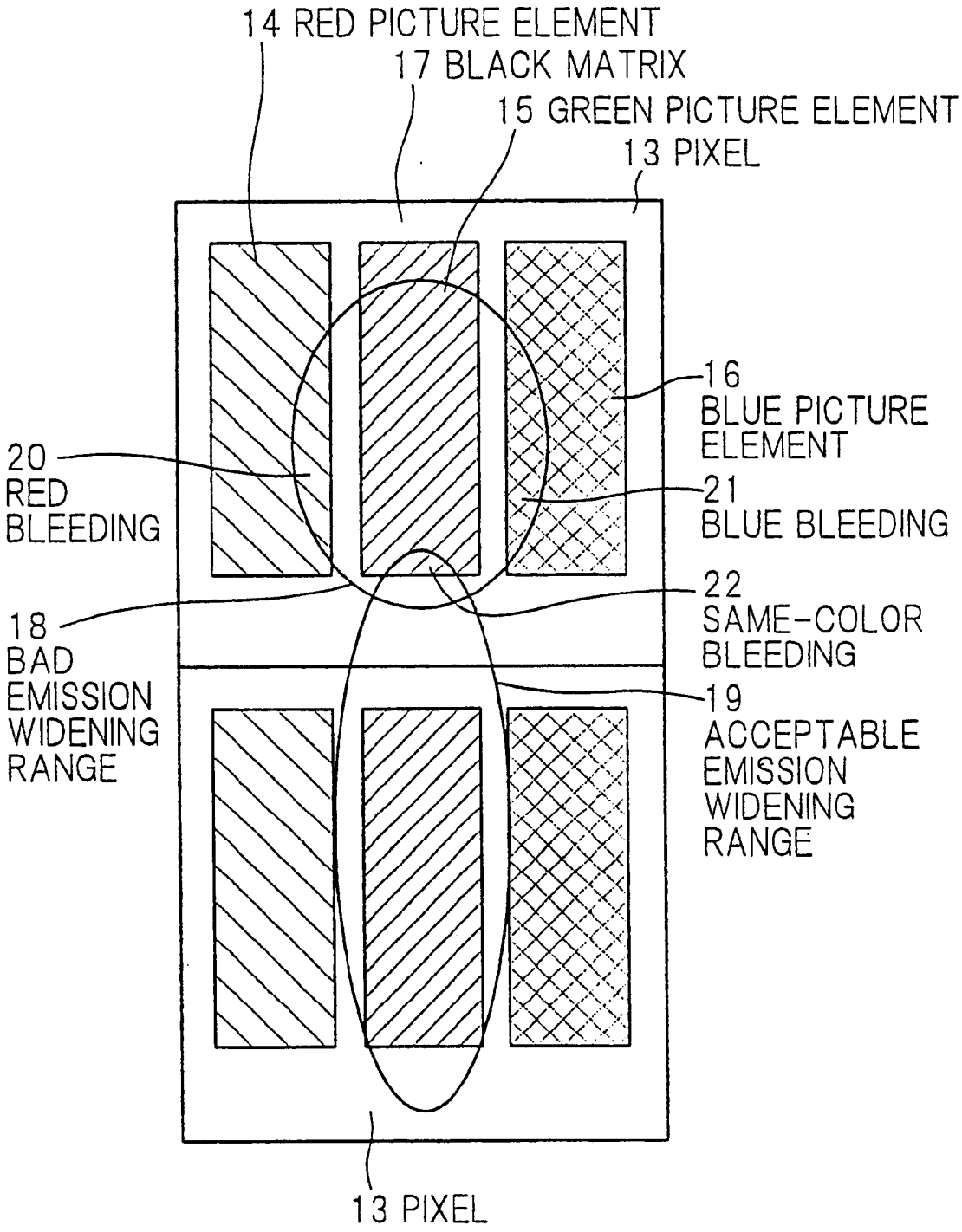
FIG. 18 is a front view showing part of FED display in a sixth preferred embodiment according to the invention.

The seventh preferred embodiment of the invention is explained below. FIG. 18 is a front view showing part of FED display, which is viewed from the electron emission point. One pixel 13 is composed of a red picture element 14, a green picture element 15 and a blue picture element 16. A black matrix 17 fills the gaps among the picture elements 14 to 16. A bad emission widening range 18 and an acceptable emission widening range 19 are indicated by elliptic curves. Both of the ranges 18 and 19 represent emission widening states at green picture element 15.

In the bad emission widening range 18, there occurs a remarkable failure such as red bleeding 20 and blue bleeding 21. It is not acceptable since in FED even a small amount of different color mixed may cause a remarkable degradation in quality of image. On the other hand, in the emission widening range 19, there occurs only same-color bleeding 22. Although a degradation in space resolution occurs, the color is not affected badly. So, it is acceptable.

Figure 19:
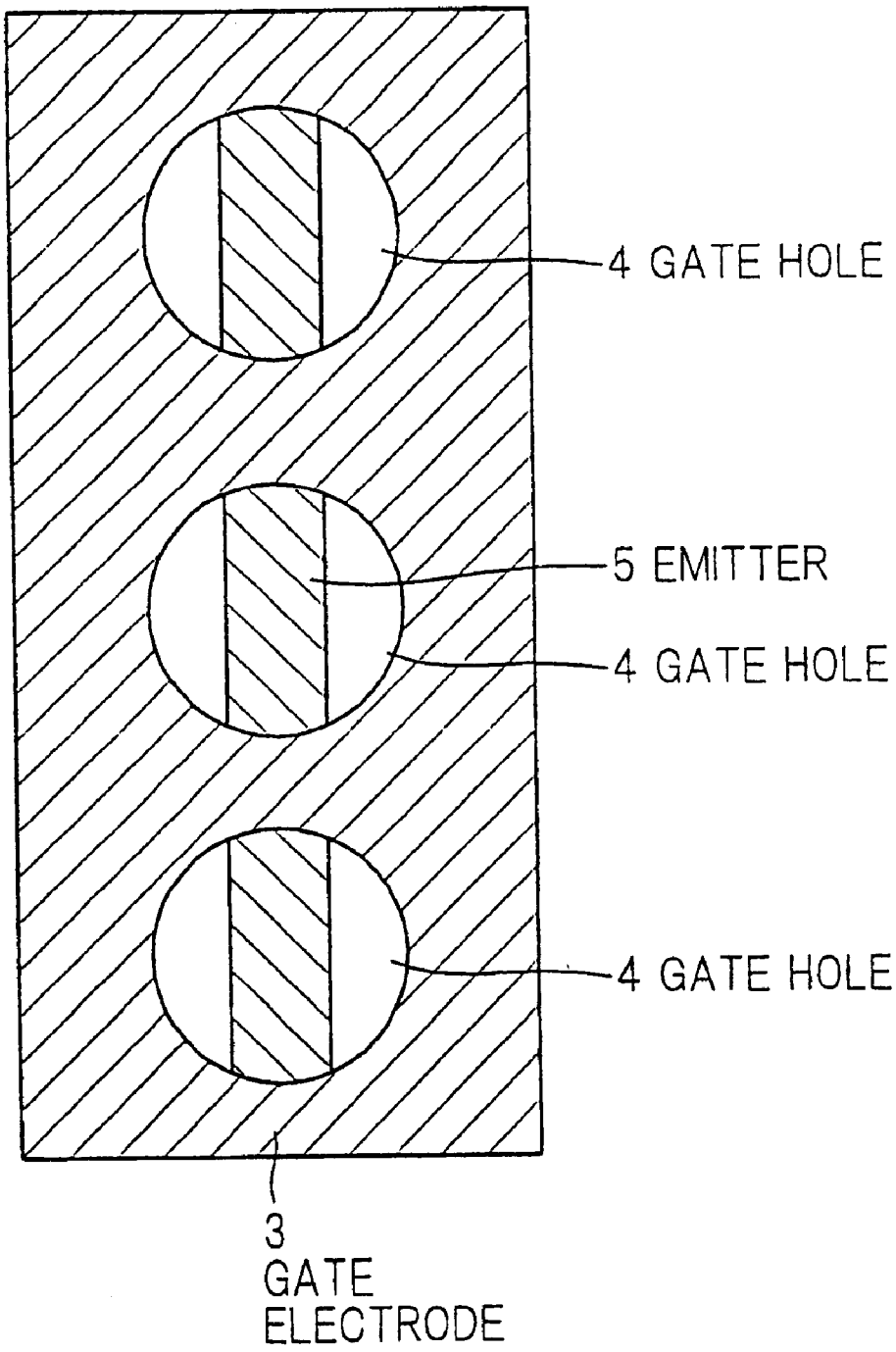
FIG. 19 shows an example of electron emission device to offer widening characteristics in a seventh preferred embodiment according to the invention.

Based on the analysis in FIG. 18, this embodiment is further explained. FIG. 19 shows an example of electron emission device to offer the widening characteristics of the acceptable emission widening range 19 in FIG. 18, where the pixel 13 is viewed from the electron emission position. In FIG. 19, three gate holes (openings) 4 are arrayed linearly in gate electrode 3, and the emitters 5 formed in the gate holes 4 are aligned. Namely, in the bottom of each of the three tubular gate holes 4 with a diameter of e.g. 10 $\mu$m formed in gate electrode 3, emitter 5 shaped like a rectangle is coated. Under the gate electrode 3, insulation film (not shown) is formed.

By shaping the electrode emitters 5 as shown in FIG. 19 in coating cathode material, the phenomenon that emission is widened in the lateral direction in FIG. 19 can be suppressed strictly. In contrast, the suppression in the vertical direction is relaxed. As a result, the same widening characteristics as shown in the acceptable emission widening range 19 in FIG. 18 are obtained. In this embodiment, as much as widened in the vertical direction, due to space charge effect, the emission can be prevented from widening uselessly in the lateral direction.

Figure 20:
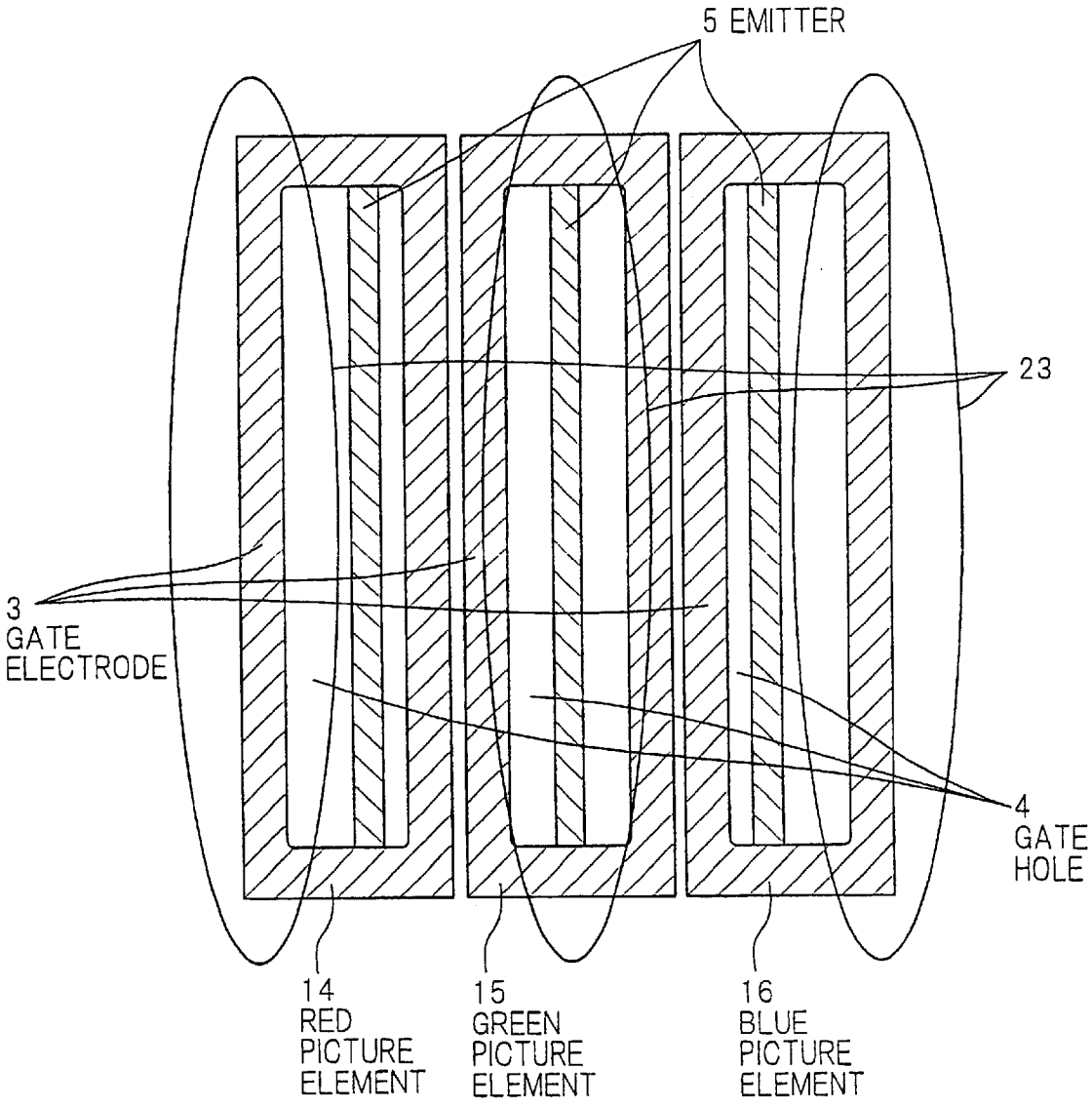
FIG. 20 is a front view showing main part of FED with one pixel composed of three picture elements R, G and B in an eighth preferred embodiment according to the invention.

The eighth preferred embodiment of the invention is explained below. FIG. 20 is a front view showing main part of FED with one pixel composed of three picture elements R, G and B shown in FIG. 18, where the emitter 5 is viewed from the same position as in FIG. 19.

As shown in FIG. 20, in FED, for red picture element 14, green picture element 15 and blue picture element 16, the gate hole 4 is formed as a nearly rectangle, and the emitter 5 is formed like a strip along the longitudinal direction of the nearly rectangle hole. Three picture elements, each of which is composed of emitter 5 and gate electrode 3, are arrayed in a row. The emitter 5 of the first picture element located at the center of the three picture elements extends longitudinally at the center of the nearly rectangular gate hole 4. The emitter 5 of the second picture element located at the left end of the three picture elements extends longitudinally on the first picture element side of the nearly rectangular gate hole 4. Also, the emitter 5 of the third picture element located at the right end of the three picture elements extends longitudinally on the first picture element side of the nearly rectangular gate hole 4.

This embodiment is characterized by that the corresponding fluorescent parts 7 (not shown) of the picture elements 14 to 16 are departed from each other, while the corresponding gate holes 4 of the picture elements 14 to 16 come close to each other. To correspond to this relation, electron emitted from the emitter 5 of the green picture element 15 is assigned to emission widening range 23 directly above, electron emitted from the emitter 5 of the red picture element 14 is assigned to emission widening range 23 above left, and electron emitted from the emitter 5 of the blue picture element 16 is assigned to emission widening range 23 above right. To yield these widening range characteristics, used in this embodiment are the gate hole 4 with vertically-elongated rectangular shape and rounded corners and the emitter 5 with vertically-elongated rectangular shape. In addition, the emitter 5 of red picture element 14 is disposed shifted to the right from the center of gate hole 4, the emitter 5 of green picture element 15 is disposed at the center of gate hole 4, and the emitter 5 of blue picture element 16 is disposed shifted to the left from the center of gate hole 4.

Figure 21:
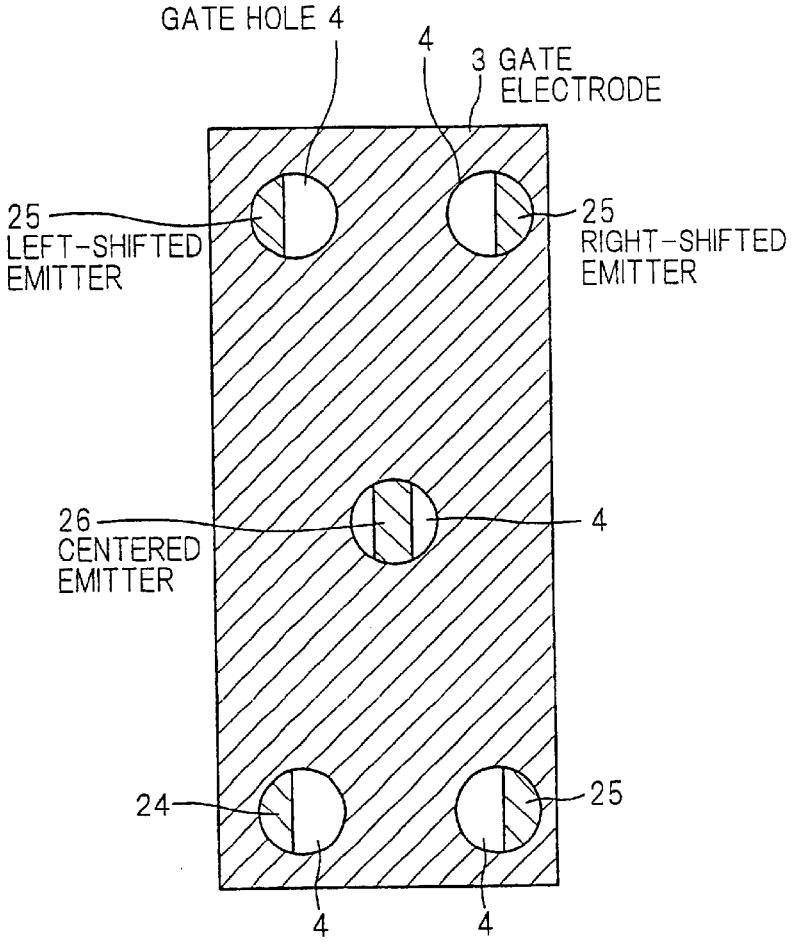
FIG. 21 is a front view showing main part of FED with one pixel composed of three picture elements R, G, and B in a ninth preferred embodiment according to the invention.

The ninth preferred embodiment of the invention is explained below. FIG. 21 is a front view showing an electron emission device corresponding to the green picture element 15 in FIG. 18. In FIG. 21, the gate electrode 3 is formed as a nearly rectangle, and the gate holes 4 are formed at the center and corners of the gate electrode 3. In gate hole 4 located at the center, emitter 26 extends longitudinally along the gate electrode 3 at the center of the gate hole 4. In gate holes 4 located at the corners, emitters 24, 25 are shifted outside from the center of the gate hole 4. Namely, five gate holes 4 are formed in the gate electrode 3, and the emitters 24, 25 are formed in the bottom of the respective gate holes 4 by coating cathode material. In this embodiment, the position where the cathode material is coated is made to be different, depending on the location of gate holes 4.

In the above composition, for leftward-disposed gate holes 4, cathode material is coated only on the left side. On the contrary, for rightward-disposed gate holes 4, cathode material is coated only on the right side. For the center gate hole 4, cathode material is coated at the center like the case in FIG. 19. Thereby, the emission widening range can be set properly. Meanwhile, to e.g. gate hole 4 located above right, no consideration to coating the gate material in the gate hole 4 located upward is given. This is based on the consideration concerning the acceptable emission widening range in FIG. 18.

As described above, the first to ninth embodiments of the invention can offer the electron emission devices having the improved emission widening characteristics as well as the simple composition. In FED, even when a small ratio of emission electrons are plunging into a substandard region, due to the big total number of electrons, a degradation in quality of image may be caused. Therefore, the emission widening at the maximum emission amount is handled most strictly. The first to ninth embodiments of the invention can yield advantages, especially in the improvement of widening characteristics at the maximum emission amount.

Also, when the electron emission devices in the above embodiments are applied to an electron beam application device such as a travelling-wave tube amplifier, a CRT, an electron beam exposure system etc., it is not necessary to converge by complicated lens system because of having the thin beam originally, it is unlikely to be affected by various aberrations of lens, and it is not necessary to worry about the enlargement of image caused by lens. Therefore, very thin electron beams can be obtained from the electron extraction part.

Furthermore, since the electron emission devices in the above embodiments use a manner to take out electrons by electric field, it is not to heat the emitter of cathode material. So, it is not to worry about the mechanical dimensional distortion by heat, or the degradation of peripheral parts by radiation heat. Therefore, the range of selection in materials to compose the electron emission device can be widened. So, it can be further micro-structured.

Now, a method of driving the electron emission device according to the invention will be explained below.

In a display that light is emitted by exciting fluorescent part by electrons, brightness of emission L is given by:

$$L=k\cdot I\cdot V\cdot(t/T)\cdot(s/S) \tag{6}$$

where emission efficiency of fluorescent part is k, amount of electron current is I, acceleration voltage is t, 1 frame time is T, emission area is s and whole pixel area is S.

Figure 22:
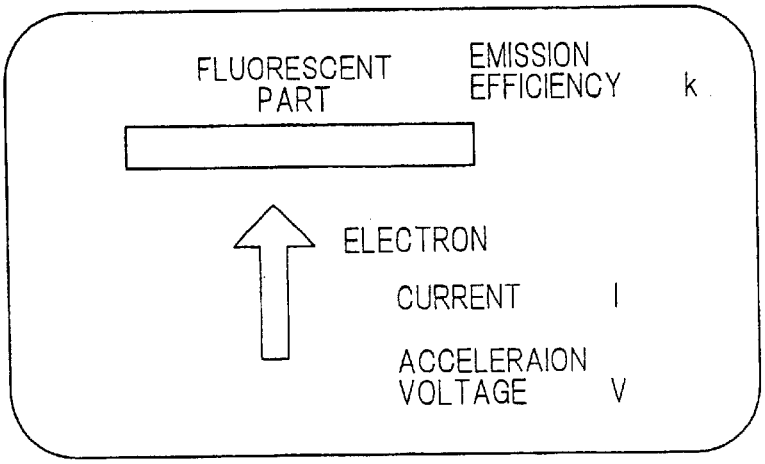
FIG. 22 is an illustration showing the analogue modulation system.

FIG. 22 is an illustration showing the analogue modulation system. The emission efficiency in expression (6) is an efficiency to convert electron energy into light, and multiplication of amount of electron current I with acceleration voltage V is the electron energy. The amount of electron current I can be changed by controlling voltage applied between gate and cathode. The acceleration voltage V is a potential difference between cathode voltage and anode voltage. Typically, anode voltage of e.g. about 2 to 6 kV is used to cathode voltage. In analogue modulation system, the gradation of brightness is represented by modulating the amount of current I by modulating gate voltage to cathode voltage.

Figure 23:
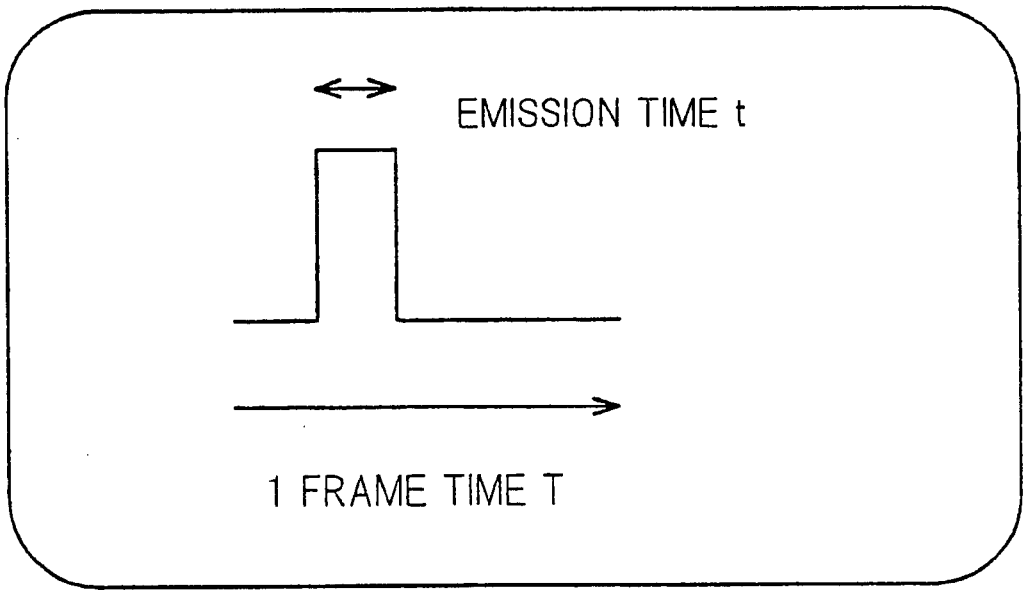
FIG. 23 is an illustration showing the pulse width modulation system.

FIG. 23 is an illustration showing the pulse width modulation system. t/T in expression (6) is a factor necessary to consider when radiating electrons like a pulse in a displaying period. In a limited period of frame, which is a certain displaying period, the display emits light for an emission time of t. When t/T is small, average brightness in one-frame time T lowers. Since human eyes have the residual image effect, the emission brightness corresponds to this average brightness. Most of plasma display panels (PDP) and liquid-crystal displays (LCD) change the brightness gradation by the pulse width modulation to vary t/T.

Although k in expression (6) is handled as constant value, in actual fluorescent parts, there exists a saturation phenomenon where the brightness does not increase even when current of more than a certain value is input. In the emission of electron, there exists threshold electric field intensity where electrons start emitting. At electric field lower than the threshold electric field, electrons do not start emitting.

Based on the properties above, the method of driving the electron emission device is explained below. In this invention, for the analogue modulation system, employed can be the following methods;

(1) a driving method that the electric field between anode and cathode is set as a threshold value, (2) a driving method that the electric field between anode and cathode is set as intermediate electric field between threshold electric field and electric field for maximum amount of current, and (3) a driving method that the electric field between anode and cathode is set as electric field for maximum amount of current.

In the driving method (1), it can be operated using a positive voltage by which the gate modulation potential is not biased. In using a display composed of multiple pixels, when the threshold electric fields of pixel are different each other, it is set to be a threshold value at the minimum potential. Some dispersion can be stored into external semiconductor storage and then used for the gate modulation.

In the driving method (2), various settings are available. In the first setting example, the electric field between anode and cathode is set to be electric field applied most frequently, and the gate potential is modulated in both polarities of positive/negative. Thereby, time when the gate potential is at zero can be elongated, and the drive consumption power can be reduced. In the second setting example, the electric field between anode and cathode is set to be the intermediate electric field between threshold electric field and electric field for maximum amount of current. Thereby, the amplitude of gate potential modulation can be minimized.

In the driving method (3), the gate modulation can be performed by only negative potential, therefore the composition of gate modulation circuit can be simplified. Also, when only zero potential occurs due to a failure in the gate modulation circuit, or when only floating potential occurs due to breaking of wire, the screen takes the maximum brightness, therefore the failures can be checked quickly. So, it can be utilized as temporary emergency lighting.

The driving methods (1) to (3) can be also applied to the pulse width modulation system, and the same advantages as above can be enjoyed. For example, when conducting the driving method (2) by the pulse width modulation system, by setting a duty of 50% at electric field with a high frequency of brightness, the drive load can be reduced. In the pulse width modulation system, even when the minimum bit pulse is short and the frequency is high, by continuing multiple bits and keeping them at the same condition, thereby reducing the substantial frequency, resultingly, the drive load (charge and discharge phenomenon) can be reduced. Owing to the state of 50% duty where it is turned on during half period of one frame and turned off during another period, the load can be minimized.

The method of driving an electron emission device in this invention is explained from another point of view. For example, conventionally, systems that a high potential is given to anode electrode and a low potential is given to gate electrode are often used, and are suitably used in taking out electrons by providing higher electric field between gate and cathode than the periphery. However, this invention, on the contrary, is characterized in that the emission of electron is suppressed by providing lower electric field between gate and cathode than the periphery. Based on this character, the method of driving the electron emission device in this invention is further explained.

In steady state, since the electric field between anode and cathode exceeds a threshold value, it is necessary to suppress it by gate voltage. In this driving method, in starting to apply voltage (in actuating the device) or stopping it, the applying of gate potential does not stop until the electric field between gate and cathode is less than the threshold electric field.

An example of the method of driving an electron emission device in this invention is explained below.

When threshold electric field is 2V/$\mu$m and electric field between in steady state is 5 kV/$\mu$m, the applying of gate potential is not conducted for anode/cathode electric field in the starting of less than 1.9 V/$\mu$m, and when reaching this value the gate potential is applied so that the gate/cathode electric field is 1.9 V/$\mu$m. Then, the gate/cathode electric field increases to 5 kV/$\mu$m. In the ending operation, the reverse procedure is conducted. By thus operating, the gate potential of 1.9 V/$\mu$m can be applied when the electric field around the gate electrode comes to 1.9 V/$\mu$m, therefore it incurs no discharge accident and no emission of electron.

Next, a method of making the electron emission substrate where CNT is used as the cathode material is explained. FIGS. 24A to 24D are cross sectional views showing sequentially the process of making a cone-shaped hollow cathode structure inside the gate hole.

Figure 24A:
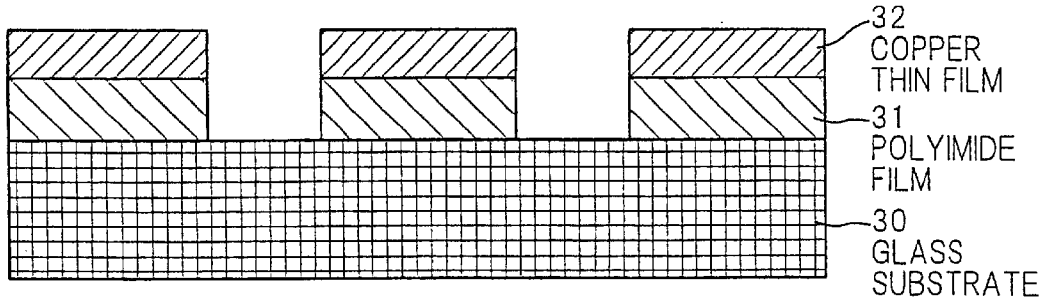
FIGS. 24A to 24D are cross sectional views showing sequentially a method of making a cone-shaped hollow cathode structure inside the gate hole.

As shown in FIG. 24A, at first, thin film (not shown) of aluminum metal is formed on a glass substrate 30 and is then patterned. Then, polyimide film 31 of 50 $\mu$m thick is coated by sputtering. Further, copper thin film 32 of 20 $\mu$m thick is deposited on the polyimide film 31 by plating, and then resist film (not shown) is coated and patterned, then by etching the copper thin film 32 gate electrode is formed. Then, by further etching the polyimide film 31 using the copper thin film 32 as a mask, insulation film is formed. Thus, the gate hole 34 with a diameter of 50 $\mu$m is obtained.

Figure 24B:
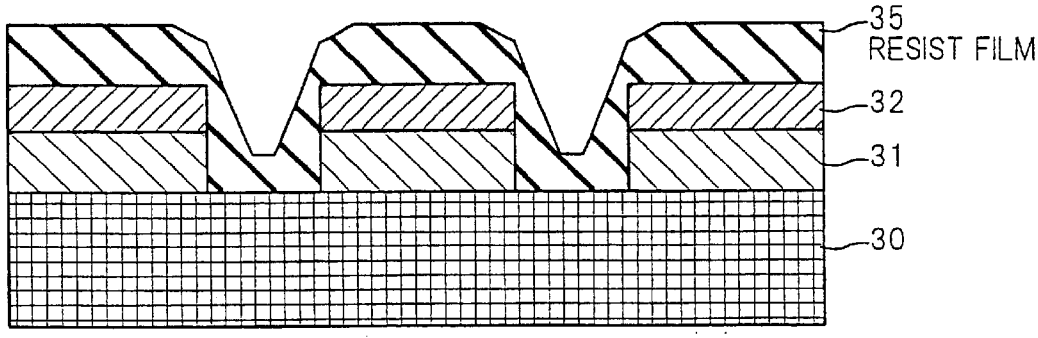

As shown in FIG. 24B, CNT-included resist film 35 of about 1 $\mu$m on the flat region is formed on the surface of gate electrode 32 and in the bottom of the gate hole 34. Although in FIG. 24B the CNT-included resist film 35 is illustrated as it is formed continuing even at the end face of the gate hole 34, but it may be gapped at the end face. The CNT-included resist film 35 in the gate hole 34 is, as shown, formed as a cone-shaped hollow, by surface tension of liquid.

Figure 24C:
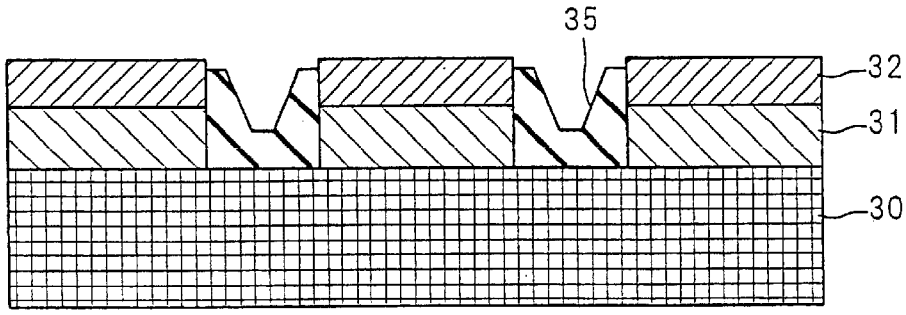

As shown in FIG. 24C, the CNT-included resist film 35 coated on the surface of gate electrode 32 is removed by CMP (chemical mechanical polishing) method. In FIG. 24C, the CNT-included resist film 35 coated in the gate hole 34 is left.

Figure 24D:
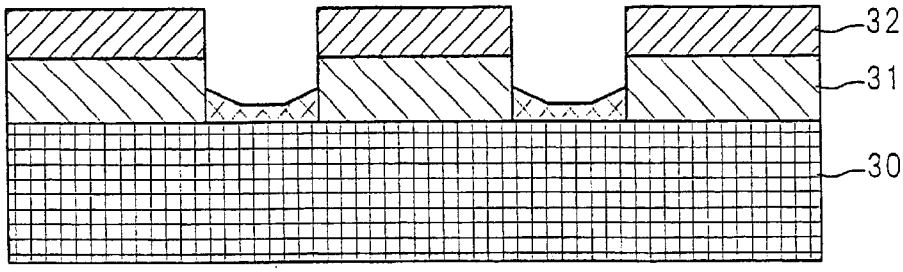

As shown in FIG. 24D, in the atmosphere, conducting the thermal treatment at about 300° C. for 20 min., thereby vaporizing and removing organic material as the main ingredient of CNT-included resist film 35, the volume reduces. Thus, only CNT is left being formed as a cone-shaped hollow, at the bottom of the gate hole 34.

Figure 25A:
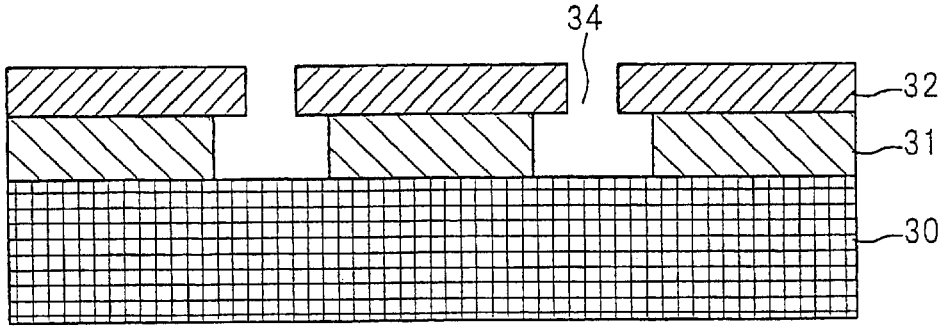
FIGS. 25A to C are cross sectional views showing sequentially another method of making a cone-shaped hollow cathode structure inside the gate hole.
Figure 25B:
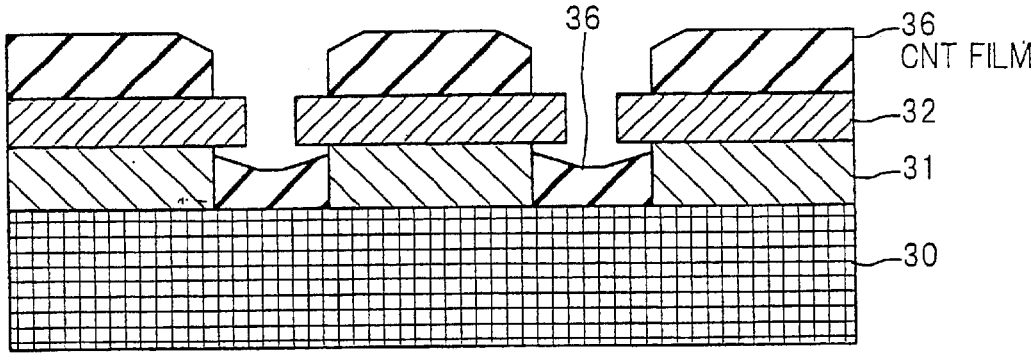
Figure 25C:
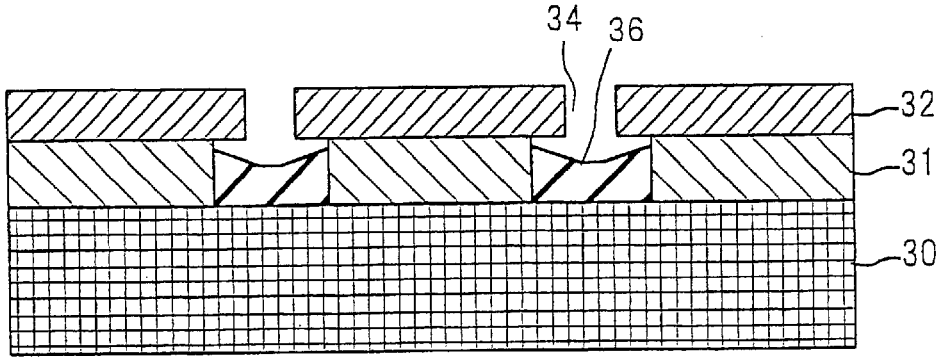

Furthermore, another method of making the electron emission substrate where CNT is used as the cathode material is explained. FIGS. 25A to 25C are cross sectional views showing sequentially the process of making a cone-shaped hollow cathode structure inside the gate hole.

As shown in FIG. 25A, at first, thin film (not shown) of aluminum metal is formed on a glass substrate 30 and is then patterned. Then, polyimide film 31 of 50 $\mu$m thick is coated by sputtering. Further, copper thin film 32 of 20 $\mu$m thick is deposited on the polyimide film 31 by plating, and then resist film (not shown) is coated and patterned, then by etching the copper thin film 32 gate electrode is formed. Then, by further etching the polyimide film 31 using the copper thin film 32 as a mask, insulation film is formed. In this case, over-etching the polyimide film 31, the gate hole 34 with diameters of 50 $\mu$m at the side of gate electrode 32 and 100 $\mu$m inside the hole is obtained.

As shown in FIG. 25B, CNT film 36 of about 1 $\mu$m on the flat region is formed on the surface of gate electrode 32 and in the bottom of the gate hole 34. In this case, the CNT film 36 is gapped at the end face. The CNT film 36 in the gate hole 34 is, as shown, formed as a cone-shaped hollow, by surface tension of liquid.

As shown in FIG. 25C, the CNT film 36 coated on the surface of gate electrode 32 is removed by CMP method. In FIG. 25C, the CNT film 36 coated in the gate hole 34 is left.

As described in FIGS. 24D and 25C, the emitter (cathode electrode) at the bottom of gate hole 34 is formed as such a structure with a cone-shaped hollow that it protrudes at the sidewall of gate hole 34 toward the gate electrode 32. Therefore, by the emitter's shape with a cone-shaped hollow, the convergence electric field can be formed suitably.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. An electron emission device, comprising:

a substrate;

a gate electrode that has an opening and is disposed on said substrate;

an emitter that is formed in said opening; and an anode electrode that is disposed at a predetermined interval from said emitter;

wherein a convergence electric field is formed by which electrons to be emitted from said emitter are converged toward said anode electrode side, said convergence electric field has equipotential surface whose inclination increases from the anode electrode to the gate electrode, and a relationship represented by expression below is satisfied:

$$\{t(gk)/t(ak)\}\cdot Va<Vg<[\{t(g)+t(gk)\}/t(ak)]\cdot Va$$

where distance between the surface of said emitter and the back surface of said gate electrode is t(gk), distance between the back surface of said anode electrode and the surface of said emitter is t(ak), potential of said anode electrode is Va, potential of said gate electrode is Vg, and thickness of said gate electrode is t(g).

2. An electron emission device, comprising:

a substrate;

a gate electrode that has an opening and is disposed on said substrate;

an emitter that is formed in said opening; and an anode electrode that is disposed at a predetermined interval from said emitter;

wherein a convergence electric field is formed by which electrons to be emitted from said emitter are converged toward said anode electrode side, wherein said convergence electric field is formed by setting so that gate/emitter electric field given between said gate electrode and said emitter is smaller than gate/anode electric field given between said gate electrode and said anode electrode, and wherein said gate electrode is formed as a nearly rectangle and a plurality of said openings are formed at the center and corners of said gate electrode, in the opening located at the center, the emitter extending longitudinally along said gate electrode at the center of the opening, in the openings located at the corners, the emitters extending shifted outside from the center of said openings.

3. An electron emission device, according to claim 1, wherein:

said emitter is formed as such a structure with a cone-shaped hollow that it protrudes at the sidewall of said opening toward said gate electrode.

4. An electron emission device, according to claim 2, wherein:

said emitter is formed as such a structure with a cone-shaped hollow that is protrudes at the sidewall of said opening toward said gate electrode.

5. An electron emission device, according to claim 1, wherein:

said emitter is formed narrower than the diameter of said opening.

6. An electron emission device, according to claim 2, wherein:

said emitter is formed narrower than the diameter of said opening.

7. An electron emission device, according to claim 1, wherein:

said emitter is formed like a ring.

8. An electron emission device, according to claim 2, wherein:

said emitter is formed like a ring.

9. An electron emission device, according to claim 1, wherein:

said emitter is of cathode materials that have emission characteristics different from each other.

10. An electron emission device, according to claim 2, wherein:

said emitter is of cathode materials that have emission characteristics different from each other.

11. An electron emission device, according to claim 1, wherein:

a plurality of said openings are arrayed in said gate electrode, and said emitters formed in said openings are aligned each other.

12. An electron emission device, according to claim 2, wherein:

a plurality of said openings are arrayed in said gate electrode, and said emitters formed in said openings are aligned each other.

13. An electron emission device, according to claim 1, wherein:

said opening is formed as a nearly rectangle, and said emitter is formed like a strip along the longitudinal direction of said opening.

14. An electron emission device, according to claim 13, wherein:

three picture elements, each of which is composed of said emitter and said gate electrode, are arrayed adjacent to each other, the emitter of the first picture element located at the center of said three picture elements extends longitudinally at the center of said nearly rectangular opening, the emitter of the second picture element located at one end of said three picture elements extends longitudinally on said first picture element side of said nearly rectangular opening, and the emitter of the third picture element located at another end of said three picture elements extends longitudinally on said first picture element side of said nearly rectangular opening.

15. An electron emission device, comprising:

a substrate;

a gate electrode that has an opening and is disposed on said substrate;

an emitter that is formed in said opening; and an anode electrode that is disposed at a predetermined interval from said emitter;

wherein a convergence electric field by which electrons to be emitted from said emitter is converged toward said anode electrode side is formed, wherein said convergence electric field is formed by setting so that gate/emitter electric field given between said gate electrode and said emitter is smaller than gate/anode electric field given between said gate electrode and said anode electrode, wherein said opening is formed as a nearly rectangle, and said emitter is formed like a strip along the longitudinal direction of said opening, and wherein three picture elements, each of which is composed of said emitter and said gate electrode, are arrayed adjacent to each other, the emitter of the first picture element located at the center of said three picture elements extends longitudinally at the center of said nearly rectangular opening, the emitter of the second picture element located at one end of said three picture elements extends longitudinally on said first picture element side of said nearly rectangular opening, and the emitter of the third picture element located at another end of said three picture elements extends longitudinally on said first picture element side of said nearly rectangular opening.

16. An electron emission device, according to claim 1, wherein:

said gate electrode is formed as a nearly rectangle and a plurality of said openings are formed at the center and corners of said gate electrode, in the opening located at the center, the emitter extending longitudinally along said gate electrode at the center of the opening, in the openings located at the corners, the emitters extending shifted outside from the center of said openings.

17. A method for driving the electron emission device according to claim 1, wherein:

electric field between said anode electrode and said emitter is set as a threshold value.

18. A method for driving the electron emission device according to claim 2, wherein:

electric field between said anode electrode and said emitter is set as a threshold value.

19. A method for driving the electron emission device according to claim 1, wherein:

electric field between said anode electrode and said emitter is set as intermediate electric field between threshold electric field and electric field for the maximum amount of current.

20. A method for driving the electron emission device according to claim 2, wherein:

electric field between said anode electrode and said emitter is set as intermediate electric field between threshold electric field and electric field for the maximum amount of current.

21. A method for driving the electron emission device according to claim 1, wherein:

electric field between said anode electrode and said emitter is set as electric field for the maximum amount of current.

22. A method for driving the electron emission device according to claim 2, wherein:

electric field between said anode electrode and said emitter is set as electric field for the maximum amount of current.

23. An electron emission device, comprising:

a substrate;

a gate electrode that has an opening and is disposed on said substrate;

an emitter that is formed in said opening; and an anode electrode that is disposed at a predetermined interval from said emitter;

wherein a convergence electric field is formed by which electrons to be emitted from said emitter are converged toward said anode electrode side, and wherein said gate electrode is formed as a nearly rectangle and a plurality of said openings are formed at the center and corners of said gate electrode, in the opening located at the center, the emitter extending longitudinally along said gate electrode at the center of the opening, in the openings located at the corners, the emitters extending shifted outside from the center of said openings.

* * * * *